US010005527B2

(12) United States Patent
Langlois

(10) Patent No.: US 10,005,527 B2
(45) Date of Patent: Jun. 26, 2018

(54) METHOD FOR OPTIMIZING SURFACE AREA AND USE OF ADJUSTABLE TRIM-TABS FOR INCREASING FUEL EFFICIENCY OF A WATERCRAFT

(71) Applicant: Joseph R. Langlois, Coral Springs, FL (US)

(72) Inventor: Joseph R. Langlois, Coral Springs, FL (US)

( * ) Notice: Subject to any disclaimer, the term of this patent is extended or adjusted under 35 U.S.C. 154(b) by 0 days. days.

(21) Appl. No.: 15/474,050

(22) Filed: Mar. 30, 2017

(65) Prior Publication Data

US 2017/0253306 A1 Sep. 7, 2017

Related U.S. Application Data

(63) Continuation-in-part of application No. 14/997,244, filed on Jan. 15, 2016.

(51) Int. Cl.
*B63B 39/06* (2006.01)
*B63B 1/22* (2006.01)

(52) U.S. Cl.
CPC ..... *B63B 39/061* (2013.01); *B63B 1/22* (2013.01); *B63B 2039/065* (2013.01)

(58) Field of Classification Search
CPC ..... B63B 39/061; B63B 1/22
USPC ..... 114/285
See application file for complete search history.

(56) References Cited

U.S. PATENT DOCUMENTS 5,383,419 A * 1/1995 Stevens ..... B63B 1/22 114/286
5,474,013 A * 12/1995 Wittmaier ..... B63B 39/061 114/285
5,549,071 A * 8/1996 Pigeon ..... B63B 39/061 114/286
6,923,136 B1 * 8/2005 D'Alessandro ..... B63H 20/08 114/285
7,013,825 B1 * 3/2006 D'Alessandro ..... B63B 39/061 114/286
7,188,581 B1 * 3/2007 Davis ..... B63B 39/061 114/285
8,794,171 B2 * 8/2014 Jauncey ..... B63B 39/06 114/162
9,278,740 B1 * 3/2016 Andrasko ..... G05D 1/0875
2016/0375972 A1 * 12/2016 Andrasko ..... B63H 20/10 440/1
2017/0253306 A1 * 9/2017 Langlois ..... B63B 39/061

* cited by examiner

*Primary Examiner* — S. Joseph Morano
*Assistant Examiner* — Jovon E Hayes
(74) *Attorney, Agent, or Firm* — Melvin K. Silverman

(57) ABSTRACT

A method for watercraft efficiency at various speeds by use of at least one adjustable trim tab with a surface by calculating by the total surface area of the planar surface and determining the surface area necessary of the planar surface of at least one trim tab, and mounting the trim tab substantially under the hull. Provided in the method is determining the overall length of the hull, determining the maximum beam of the hull, multiplying the overall length of the hull by the maximum beam, taking a resultant of the overall length and maximum beam and multiplying that resultant by a percentage in the range of about one to about three, and taking the resultant and dividing it by the number of trim tabs mounted to the hull. Adjusting the trim tab by raising or lowering the rear of the planar surface, based on speed, to achieve higher efficiency.

9 Claims, 23 Drawing Sheets

Hull at Rest

Hull at Low Speed
With Trim Tab

Hull at High Speed
Without Trim Tab

Hull at High Speed
With Trim Tab 41
40
26

55a
57a
42a 57
55
42
55
49

*Results of Calm Water Performance Expansion*

| Run # | $V_M$ (ft/s) | $R_M$ (lb) | Trim (deg) | $Heave_M$ (in) | $Heave_C$ (ft) | $WL_M$ (ft) | $WA_M$ (ft2) | $V_S$ (knots) | $R_S$ (lb) | EHP (hp) |
|---|---|---|---|---|---|---|---|---|---|---|
| **LCG = 35% LWL \| Plane = 0 deg** | | | | | | | | | | |
| 11 | 3.45 | 0.42 | 1.6 | -0.09 | -0.18 | 2.72 | 2.28 | 10.0 | 5234 | 161 |
| 12 | 5.15 | 1.21 | 3.95 | -0.06 | -0.12 | 2.75 | 2.30 | 14.9 | 15724 | 721 |
| 13 | 6.93 | 1.54 | 4.83 | 0.31 | 0.62 | 2.38 | 1.99 | 20.1 | 19680 | 1215 |
| 14 | 8.63 | 1.87 | 5.72 | 0.69 | 1.38 | 2.01 | 1.68 | 25.0 | 23726 | 1824 |
| 15 | 10.33 | 1.94 | 6.37 | 1.21 | 2.42 | 1.62 | 1.35 | 30.0 | 24249 | 2231 |
| 16 | 6.95 | 1.58 | 4.8 | 0.29 | 0.58 | 2.40 | 2.01 | 20.2 | 20221 | 1252 |
| **LCG = 35% LWL \| Plane = 11 deg** | | | | | | | | | | |
| 65 | 3.46 | 0.52 | 1.47 | -0.04 | -0.08 | 2.73 | 2.28 | 10.0 | 6650 | 205 |
| 66 | 3.46 | 0.55 | 1.42 | -0.09 | -0.18 | 2.75 | 2.30 | 10.0 | 7071 | 218 |
| 67 | 5.13 | 1.19 | 3.28 | -0.07 | -0.14 | 2.79 | 2.34 | 14.9 | 15434 | 705 |
| 68 | 6.93 | 1.49 | 3.56 | 0.19 | 0.38 | 2.61 | 2.18 | 20.1 | 18817 | 1162 |
| 69 | 8.64 | 1.71 | 3.31 | 0.39 | 0.78 | 2.50 | 2.09 | 25.1 | 20963 | 1613 |
| 70 | 10.34 | 2 | 3.08 | 0.52 | 1.04 | 2.42 | 2.02 | 30.0 | 23988 | 2209 |

Fig. 22

METHOD FOR OPTIMIZING SURFACE AREA AND USE OF ADJUSTABLE TRIM-TABS FOR INCREASING FUEL EFFICIENCY OF A WATERCRAFT

This is a Continuation-in-Part application under 35 U.S.C. 120 of the presently co-pending patent application Ser. No. 14/997,244 filed on Jan. 15, 2016.

FIELD OF INVENTION

The present invention relates to an improvement in classical trim-tab technology to enhance the general hydrodynamic performance of a marine craft inclusive of the fuel efficiency thereof. Trim tabs have been known for many years and various forms of them have been developed in an effort to maximize attitude control, stability of the marine craft and general hydrodynamic efficiency inclusive of decrease of flow velocity under the hull and fuel efficiency.

BACKGROUND OF INVENTION

So called boat leveling devices of the trim tab type have been known for many years and various forms of them have been developed in an effort to maximize attitude control, stability of the marine craft and general hydrodynamic efficiency inclusive of decrease of flow velocity under the hull and fuel efficiency.

The prior art trim tabs are typically provided in pairs to enhance stability of the craft, which are attached directly to the transom of a watercraft and in which the attitude of the trim tab is controlled through a hydraulic piston assembly which controls relative angulation of the whole relative to level of the water.

In general trim tabs of the prior art, whether double or single acting, will operate upon the same principles and have a common objective, namely, that of contributing to the efficiency control of the boats attitude, stabilization and general hydrodynamics.

In recent years, most efforts of the prior art have been directed primary to improvement of the electronics in the development of algorithms to optimize trim tab control under various conditions of speed, shape of the boat's hull, having distribution in craft, and other hydrodynamic considerations. The prior art also has experimented with the efficiency of electric motor controls of the trim tab as opposed to that of the hydraulic systems.

The U.S. Navy has undertaken significant research and development in this area to attempt to maximize performance of a variety of its boats and, typically, of the types employed by the U.S. Coast Guard. In Navy terminology, a trim-tab is referred to as a stern flap, apparently because its engineering objectives are more ambitious than are the case with a leisure class powerboat. More particularly, the Navy has identified the following criteria as hydrodynamic mechanisms which account for improved boat performance based on optimized stern flap design.

After Body Flow Modifications:
Flow velocity under the hull decreased.
Pressure recovery increased.
Transom exit velocity increased.
Wave System Modifications:
Localized transom system wave system altered.
Near field wave heights reduced.
Far field wave energy reduced.
Secondary Stern Flap Hydrodynamic Effects:
Ship length increased.

Beneficial propulsion interactions.
Ship trim modified (bow down trim induced).
Ship sinkage reduced.
Lift and drag forces developed on flap.

The most common material used in trim tab design is stainless steel, but materials can vary between stainless steel, aluminum, bronze, brass, carbon fiber, fiberglass, or other material known to be used in trim tab design.

The within inventor has recognized that the fundamental objectives and benefits of trim tabs and stern flaps may be more effectively achieved if the entire chord length of the trim-tabs or stern flaps are extended. And that, when properly actuated and controlled, such elongated attitude control element, as suggested can accomplish and substantially improve upon the performance of prior art trim tabs and stern flaps regardless of hydrodynamic conditions. The efficiency of the present invention may be yet further improved by the assistance of contemporary electronic controls and algorithms. The present invention also improves upon efforts that seek to improve the performance of trim-tabs thereof through modifications of their geometry as, for example, is reflected in U.S. Design Pat. No. 292,392 (1987) to Zepp, entitled Boat Leveler Twin Tab and the prior art of Karafiath et al. U.S. Pat. No. 9,180,933 B1 (2015), and Cusanelli U.S. Pat. No. 6,698,370 B1 (2004).

While this use of trim tabs has been shown to help attitude control and stability, there exists a need for a method of optimizing trim-tab surface area to increase the efficiency of watercrafts, and use of an adaptable design that can alter the degree of the trim tab based on certain speeds.

SUMMARY OF THE INVENTION

A method for watercraft efficiency at various speeds by optimization of surface area and use of at least one trim tab, for calculating total surface are of each planar surface, and adjusting the angle of the trim tab based on watercraft speeds. The most common material used in trim tab design is stainless steel, but materials can vary between stainless steel, aluminum, bronze, brass, carbon fiber, fiberglass, or other material known to be used in trim tab design. The method including determining the surface area necessary of the planar surface of at least one trim tab and mounting said trim tab substantially under the hull. Further provided is determining the overall length of the hull, determining the maximum beam of the hull, multiplying the overall length of the hull by the maximum beam of the hull, taking a resultant of the overall length and maximum beam, multiplying that resultant by a percentage in the range of about one to three percent, and taking the resultant and dividing it by the number of trim tabs mounted to the hull. Yet further provided is increasing efficiency at higher speeds by using a fluid-hinge to connect the front-most portion of the planar surface to the hull and using at least one actuator to connect a rear-most portion of the planar surface to the transom of the watercraft.

Further provided is, lowering the rear of the trim tab and increasing the angle between the planar surface and the hull. Additionally provided is increasing efficiency at lower speeds by raising the rear of the trim tab and decreasing the angle between the planar surface and the hull toward about zero degrees from the horizon of the hull.

It is yet a further object to provide a system of the above type having utility in improved performance of marine craft whether used in a single or double trim-tab context.

It is still yet further object to provide a system to improve the degree and control of the glide angle of the watercraft and its ability to correct uplift zones to facilitate an artificial shifting of the center of gravity, resulting in reduced fuel costs.

The present invention also seeks to reduce the need for submersible flow interceptors as they are known in the art.

The invention therefore seeks to provide more effective trimming coupled with the greatest possible uplift and lowest water resistance values, both at slow and high speeds, in a manner that does not substantially complicate the kinematics of prior art attitude control systems.

It is accordingly an object of the present invention to provide an improved trim tab system which overcomes the various hydrodynamic limitations of the prior art, also having utility with leisure as well as naval vessels.

It is another object of the invention to provide a trim tab system capable of inducing a greater change in bow-to-stern or glide angle angulation of the marine craft relative to the water level while increasing the fuel efficiency thereof.

The above and yet other objects and advantages of the present invention will become apparent from the hereinafter set forth Brief Description of the Drawings, Detailed Description of the Invention and Claims appended herewith.

BRIEF DESCRIPTION OF THE DRAWINGS

FIGS. 13 and 13A show a side view from the starboard side of the rear hull of a watercraft looking port, showing the trim tab raised flush to the horizon of the hull, the relationship between raised and lowered, and using a Type-62 fluid hinge.

FIG. 22 is a chart of the results of the calm water performance for a tested model of a 92-foot Denison 121 Hull design in 1:24 scale.

DETAILED DESCRIPTION OF THE INVENTION

Figure 1:
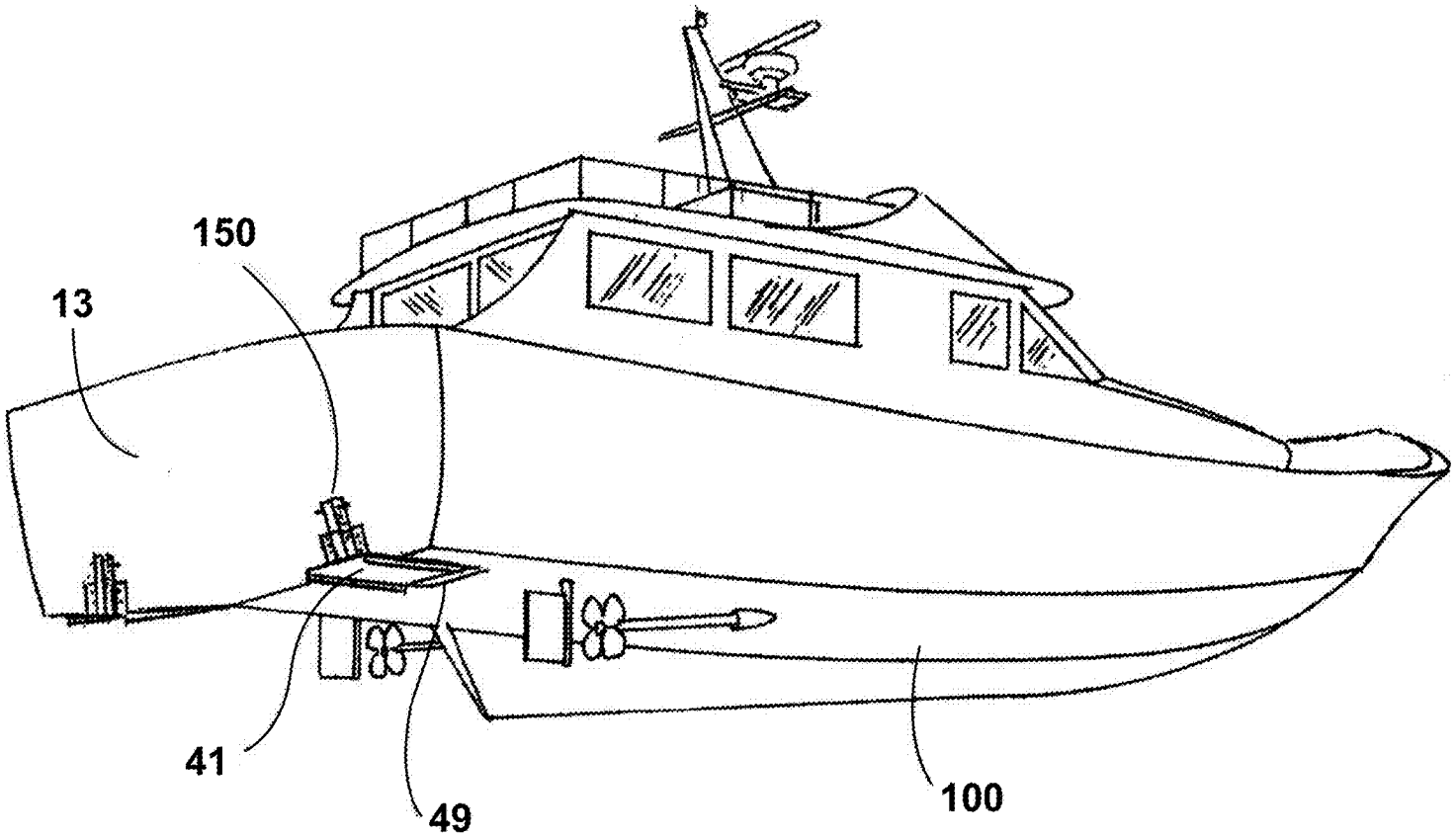
FIG. 1 is an isometric view from the rear of a generic watercraft showing placement of trim-tabs.

The term "trim" is the angle in degrees of the watercraft measured relative to a plane parallel to the waterline. "Heave" is the positive lift achieved by the hull of the watercraft. "Sinkage" is negative heave. "Resistance," also known as "drag," is force acting opposite to the relative motion of the watercraft moving with respect to a surrounding fluid. The term "fluid hinge" refers to a non-coupled connection between the planar surface and the hull of the watercraft. The term non-coupled refers to the properties of the fluid hinge that allow the planar surface to rest at low or no speed, but does not restrict the motion needed from the movement of the planar surface between raised and lowered positions of the rear of the trim tab, and further, the fluid hinge is not physically fastened to the planar surface. The term "actuator" refers to a generic component that is responsible for moving or controlling the raising and lowering of the trim tab, as any brand of actuator is not specific to this method.

The method for increasing fuel efficiency of a watercraft using at least one surface-area-optimized trim tab includes mounting a trim tab 41 under a hull 100. Using two trim tabs 41 mounted on opposite sides of the hull 100. At high speeds, a rear of the trim tab 41 is lowered by an actuator 150 to increase the lift of the hull 100, which decreases the drag created by the hull 100 by optimizing water flow under the hull 100 and surface area of the hull 100 in the water. At lower speeds, a lowered trim tab 41 would create unnecessary drag forces; the method provides for correction of this issue by raising the rear of the trim tab 41 to sit about flush with the hull 100 by use of an actuator 150 to pull the rear of the trim tab 41 up. Because of this motion, it is important to use a fluid hinge 49 which allows for free-movement of the planar surface at its location. An actuator 150 takes virtually all of the stresses of the trim tab system.

The method for calculating the total surface area necessary for the planar surface to optimize the surface area for maximum efficiency comprises determining the overall length 110 of the hull 100, determining the maximum beam 120 of the hull 100, multiplying the overall length of the hull by the maximum beam width of the hull, taking the resultant of the overall length and maximum beam and multiplying that resultant by a percentage in the range of about 1% to about 3%, and taking said resultant and dividing it by the total number of all trim tabs mounted to the hull. This will give the overall surface area needed for each trim tab. While the preferred embodiment will have a percentage of 2%, the method can be used to achieve comparable results with a percentage as low at 1%, and as high as 3% before the trim tab starts to lose its intended benefits.

The method expands on David Savitsky's research (c.f. 1964) of the prior art. Savitsky published a comprehensive paper which summarized previous experimental studies on the hydrodynamics of prismatic planning surfaces and presented a method for application of these results to design. From this data, it was determined that appropriate surface area of the trim tab, not just the angle of the trim tab, is imminently important for increasing efficiency of trim tabs. Therefore, the chord length and span of the trim tab may vary to fit different applications such as the location of trim tab placement and other obstacles on a hull 100.

Figure 2:
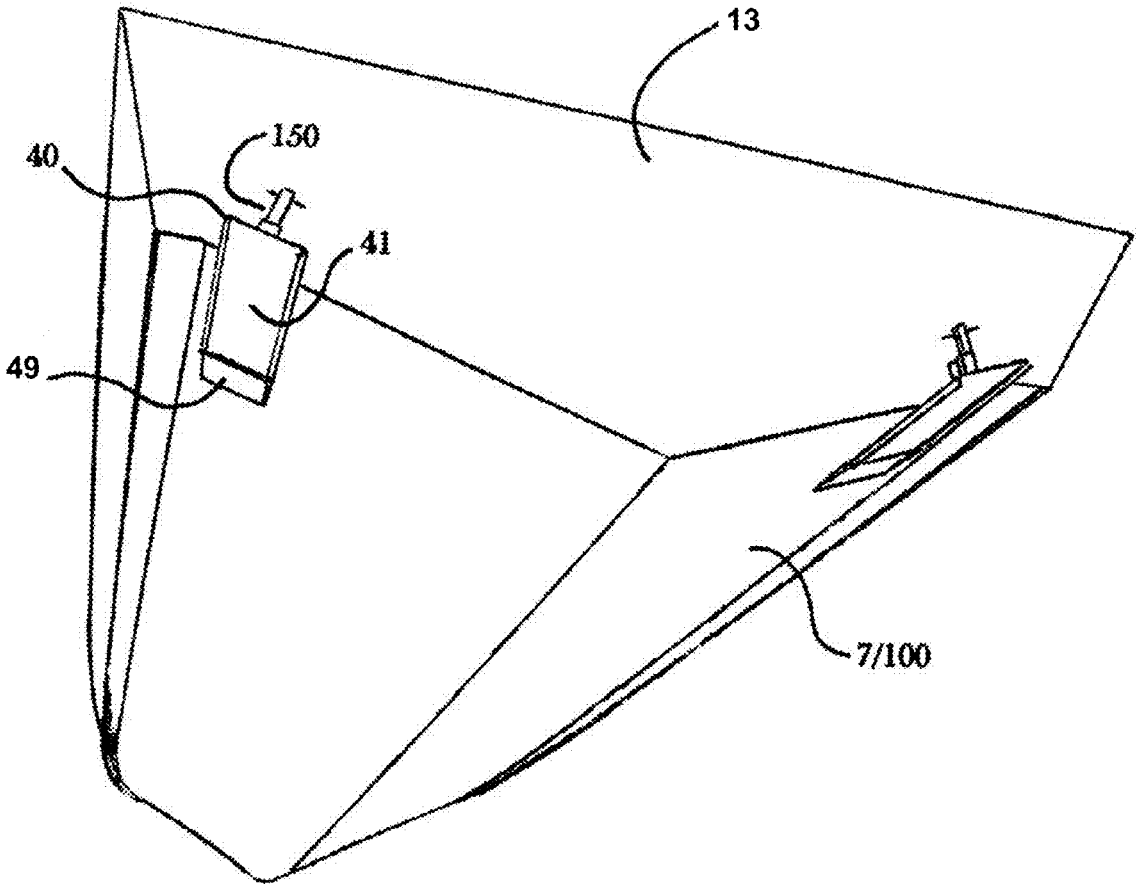
FIG. 2 is an isometric view from the rear underside of a generic hull showing the placement of the trim-tabs substantially under the watercraft.

FIG. 1 is an isometric view of a generic watercraft showing the placement of two trim tabs substantially under the rear portion of the hull; one on the port side, and one on the starboard side. "Substantially" refers to the positioning as shown in FIG. 1, where the tabs may be mostly under the hull, but stick out slightly in order to provide extra space for a connection to an actuator. FIG. 2 is an isometric view showing the rear of the hull 100 from under the watercraft. Here, a planar surface of a trim tab 41 can be seen to have linear-support-tabs 40 along the sides which may be placed for further support of the planar surface. The linear-support-tabs 40 may provide further material support against the force of the water at any given speed. The linear-support-tabs 40 create a channel as to not impede the flow of water. Further shown in FIGS. 2 and 10, Fluid hinge 49 can be seen to hold the planar surface 26 of the front of the trim tab 41 close to the under surface of the hull 100. An actuator 150 can also be seen as connecting the trim tab 41 to the transom 13 of the watercraft. The type of actuator 150 is not specific to the results in this method, and many generic actuators may work. However, since the actuator will primarily take the load of any forces on the trim tab, a bracket 152 for the actuating rod may be used to keep the actuator in the intended placement. The use of a fluid hinge 49 enables the planar surface 26 of the trim tab 41 to move freely, which in turn allows the fluid hinge 49 to adapt easily to varying degrees of angulation without unnecessary impediment of water flow. Further, this fluid hinge provides a better opportunity for retrofit applications.

Figure 3:
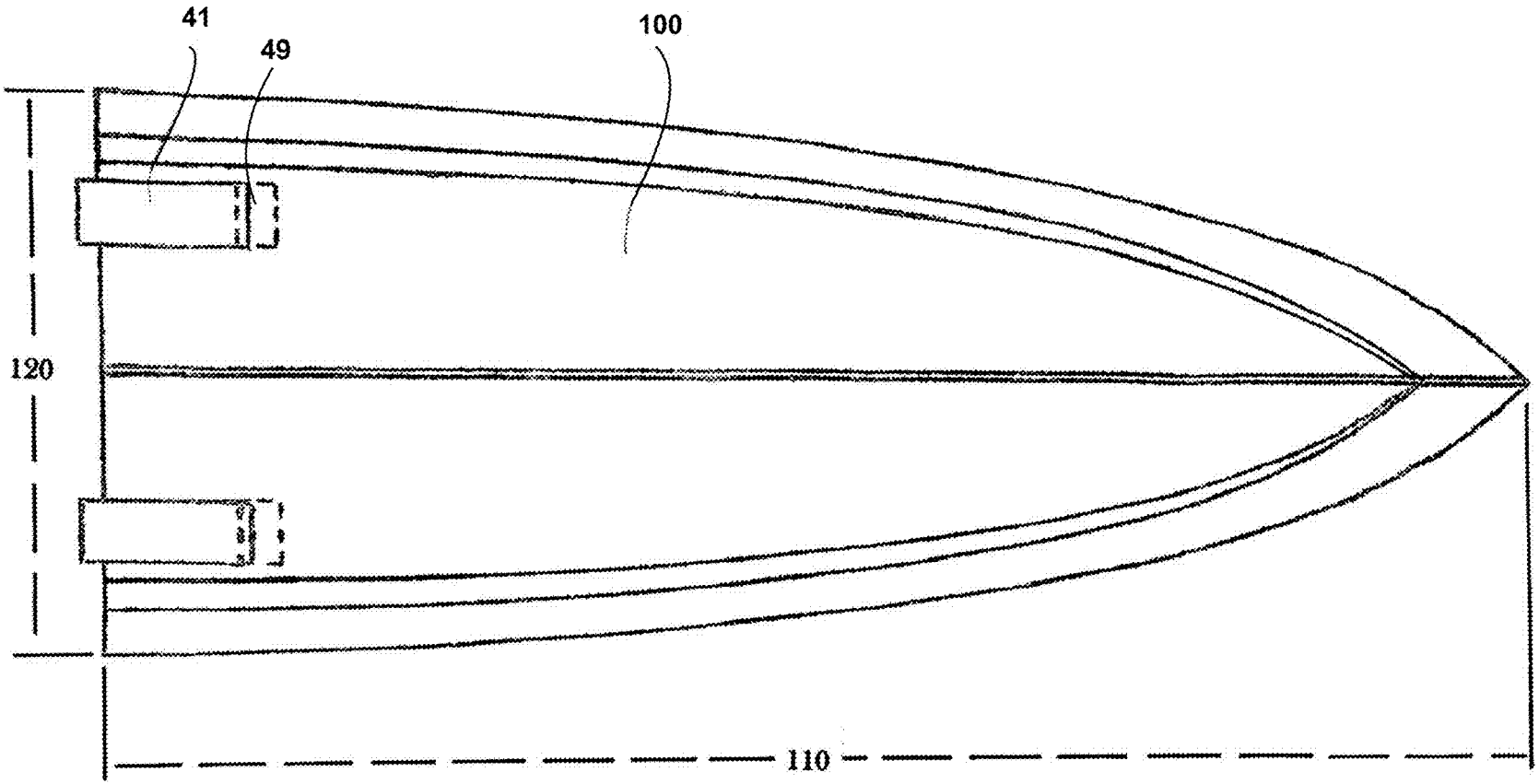
FIG. 3 is a bottom view of a hull showing length and beam of the hull.

FIG. 3 provides a two-dimensional view of the hull 100 of the watercraft and placement of the trim tabs 41 substantially under the rear of the hull. The overall length 110 of the hull 100 can be seen in this view. Additionally, the overall beam 120 of the hull 100 can be seen as well. Overall length 110 and overall beam 120 are used in the calculation of necessary surface area of the planar surface 26 of the trim tab 41.

Figure 4A:
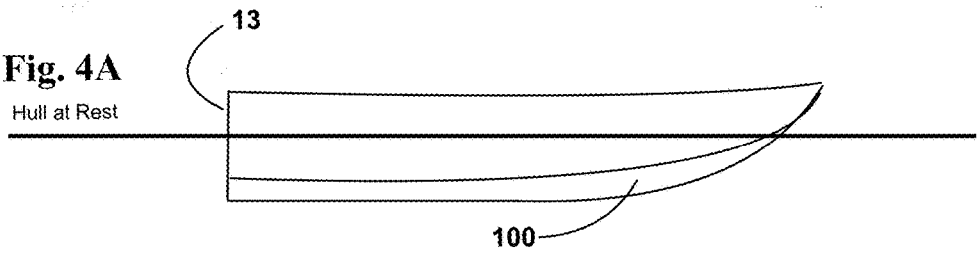
FIG. 4A is a view of a hull at rest sitting in water.
Figure 4B:
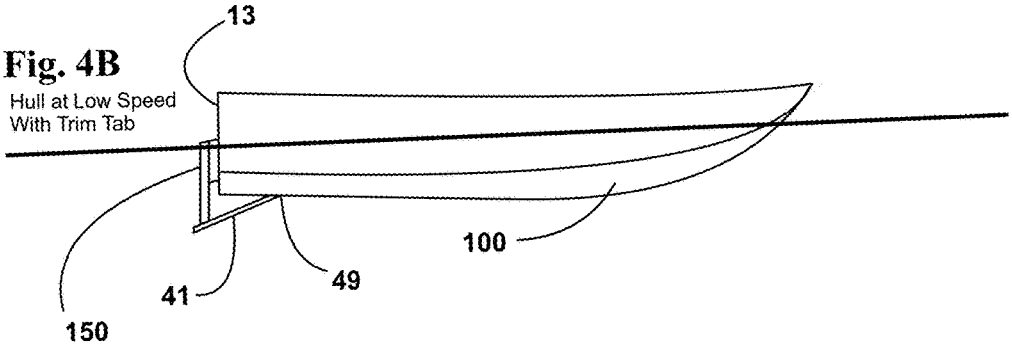
FIG. 4B is a view of a hull with an extended trim tab at low speeds demonstrating drag force on the hull.
Figure 4C:
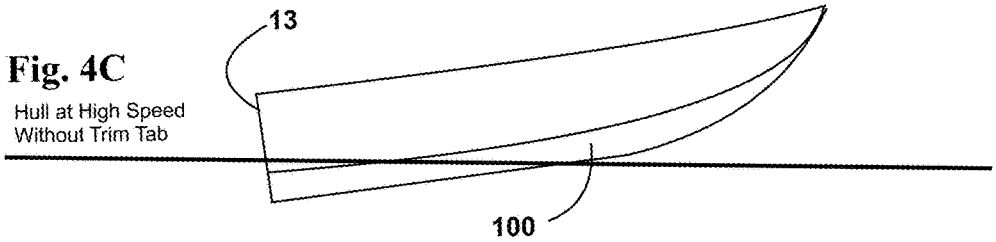
FIG. 4C is a view of a hull at high speed without a trim tab showing the rear of the hull impeding flow of water creating excessive drag.
Figure 4D:
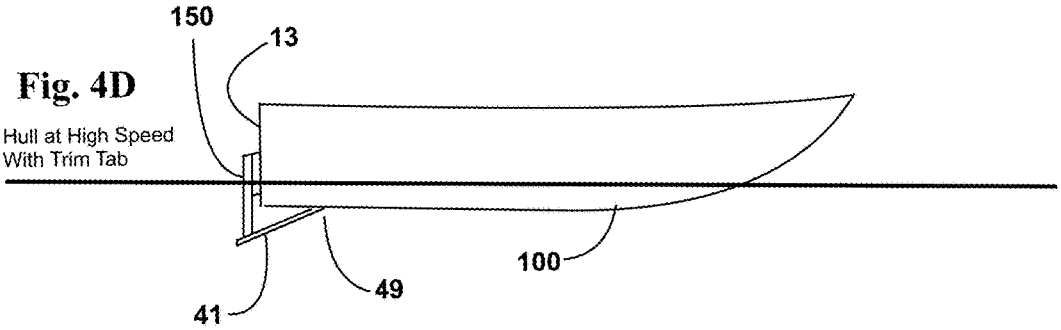
FIG. 4D is a view of a hull at high speed with a trim tab reducing drag and increasing lift.

FIGS. 4A, 4B, 4C, and 4D show a view of a hull 100 under different conditions of speed and presence of a trim tab. FIG. 4A shows a hull at rest, which would not change with or without a trim tab. FIG. 4B shows a hull at low speeds with a trim tab extended. Notice the bow of the watercraft is dipped as excess drag is placed on the hull. FIG. 4C demonstrates how a hull performs when speed is increased without a trim tab. FIG. 4D shows the correction of the watercraft trim, and the increase in heave, keeping the watercraft more level, and higher up in the water. The leveling of the hull makes water flow more efficient, and the increased heave decreases drag by minimizing surface area contact with the water.

Figures 5, 5A, 5B:
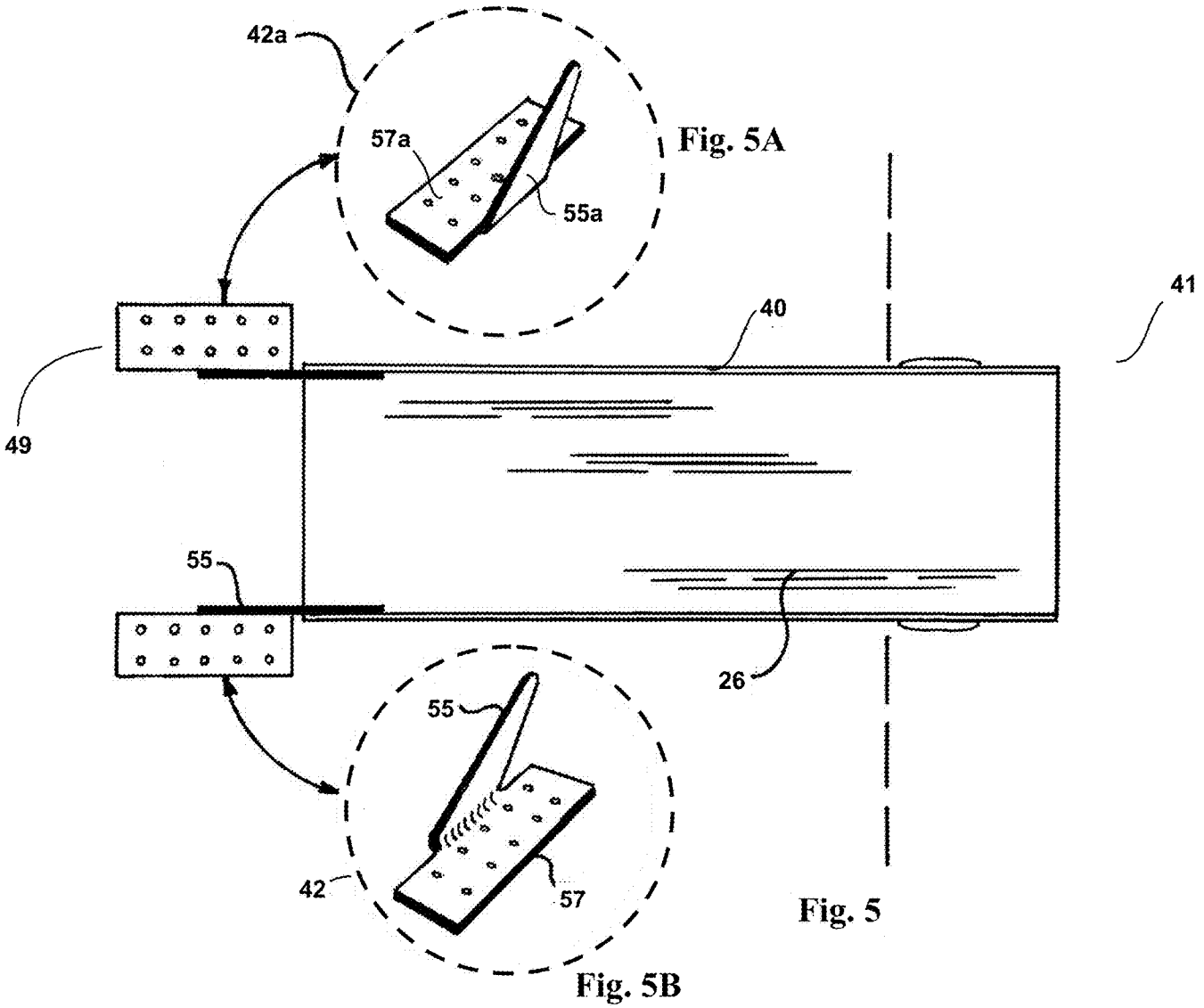
FIG. 5 is a view from the bottom of a trim tab using a Type-42 fluid hinge.
FIGS. 5A and 5B show the brackets for Type-42 fluid hinge
Figure 7:
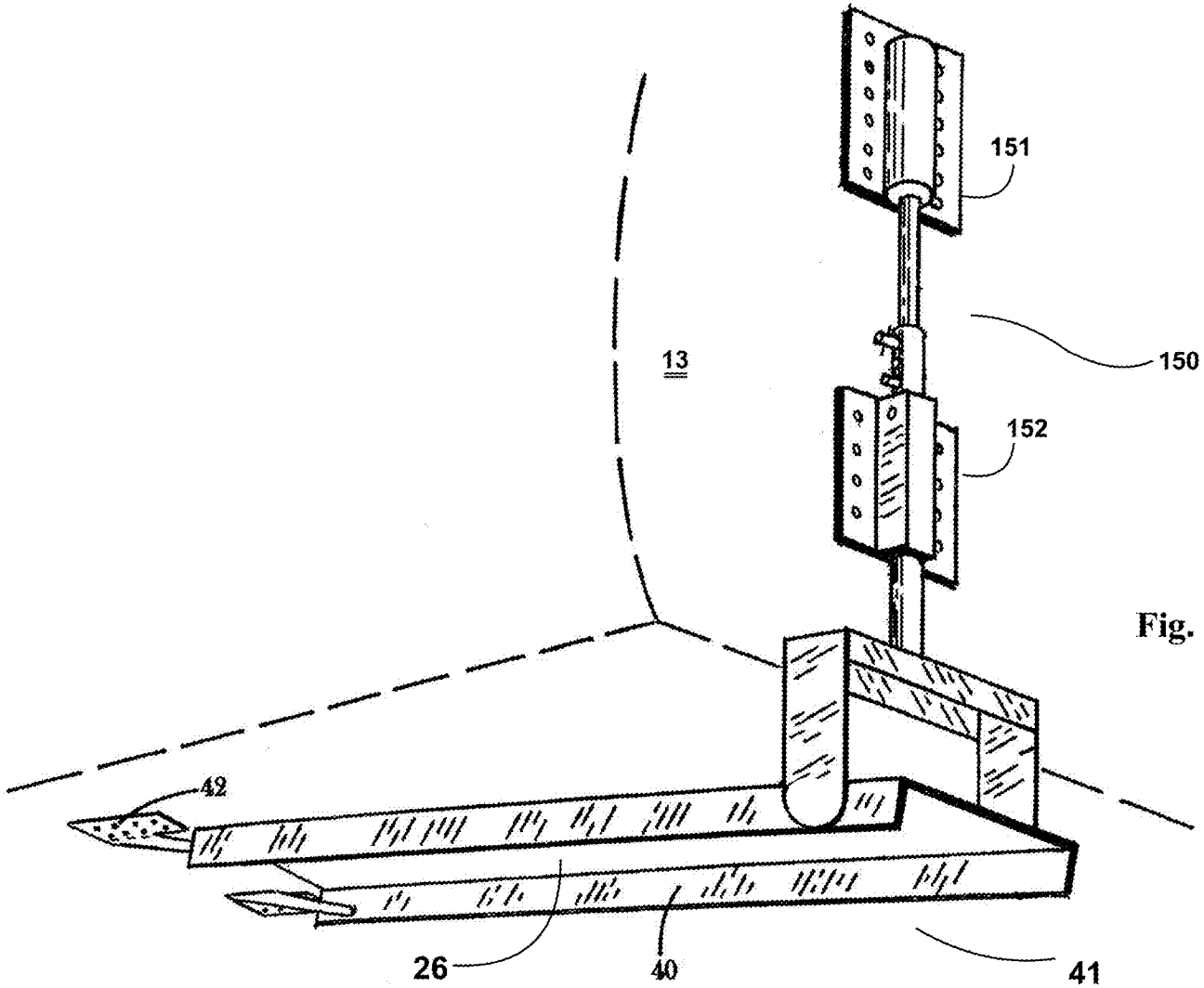
FIG. 7 is an isometric view from the rear of a watercraft, showing the trim tab extended below the horizon of the hull.
Figure 8:
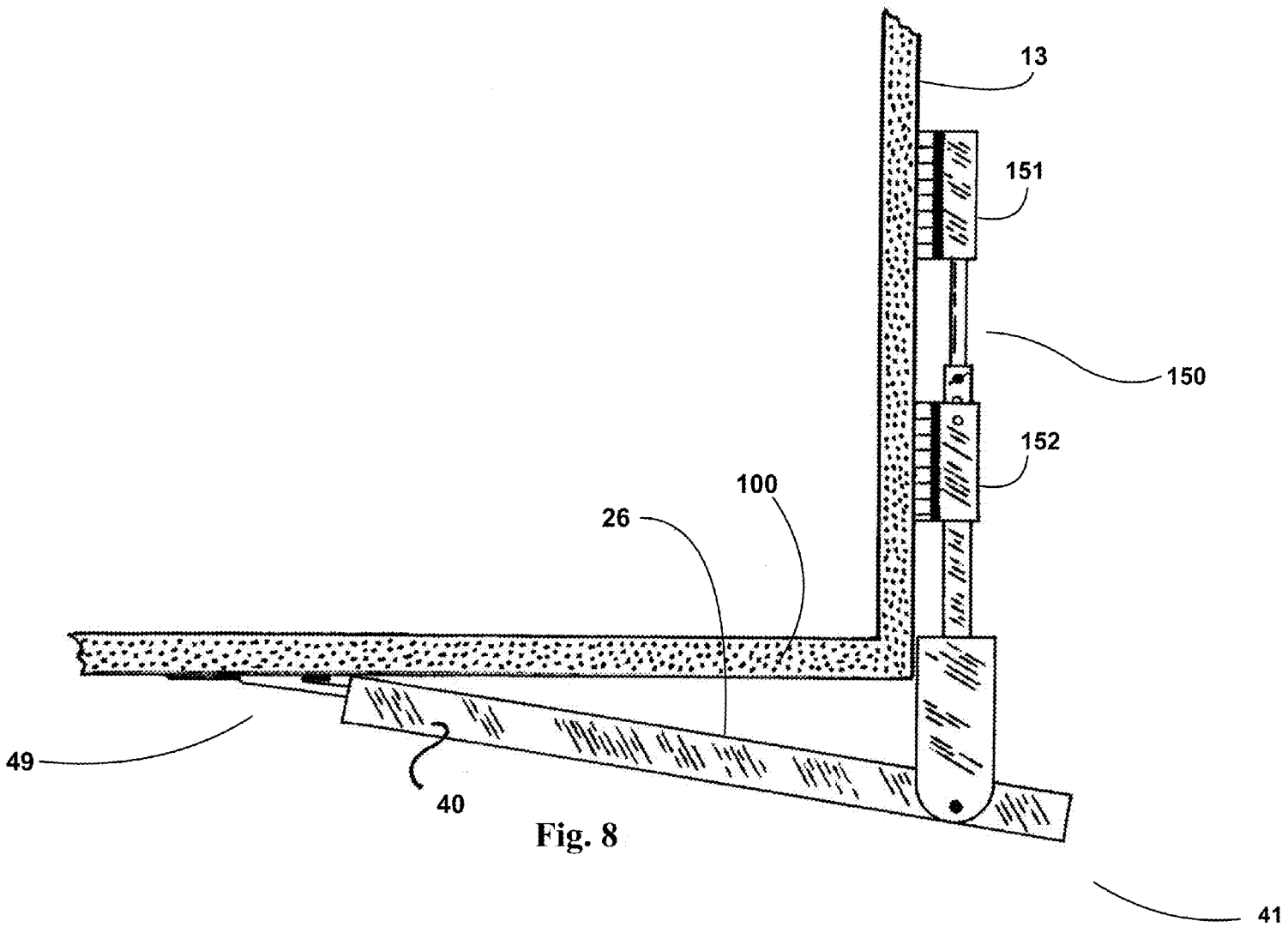
FIG. 8 is a side view from the port side of the rear hull of a watercraft looking starboard showing the trim tab extended below the horizon of the hull.
Figure 10:
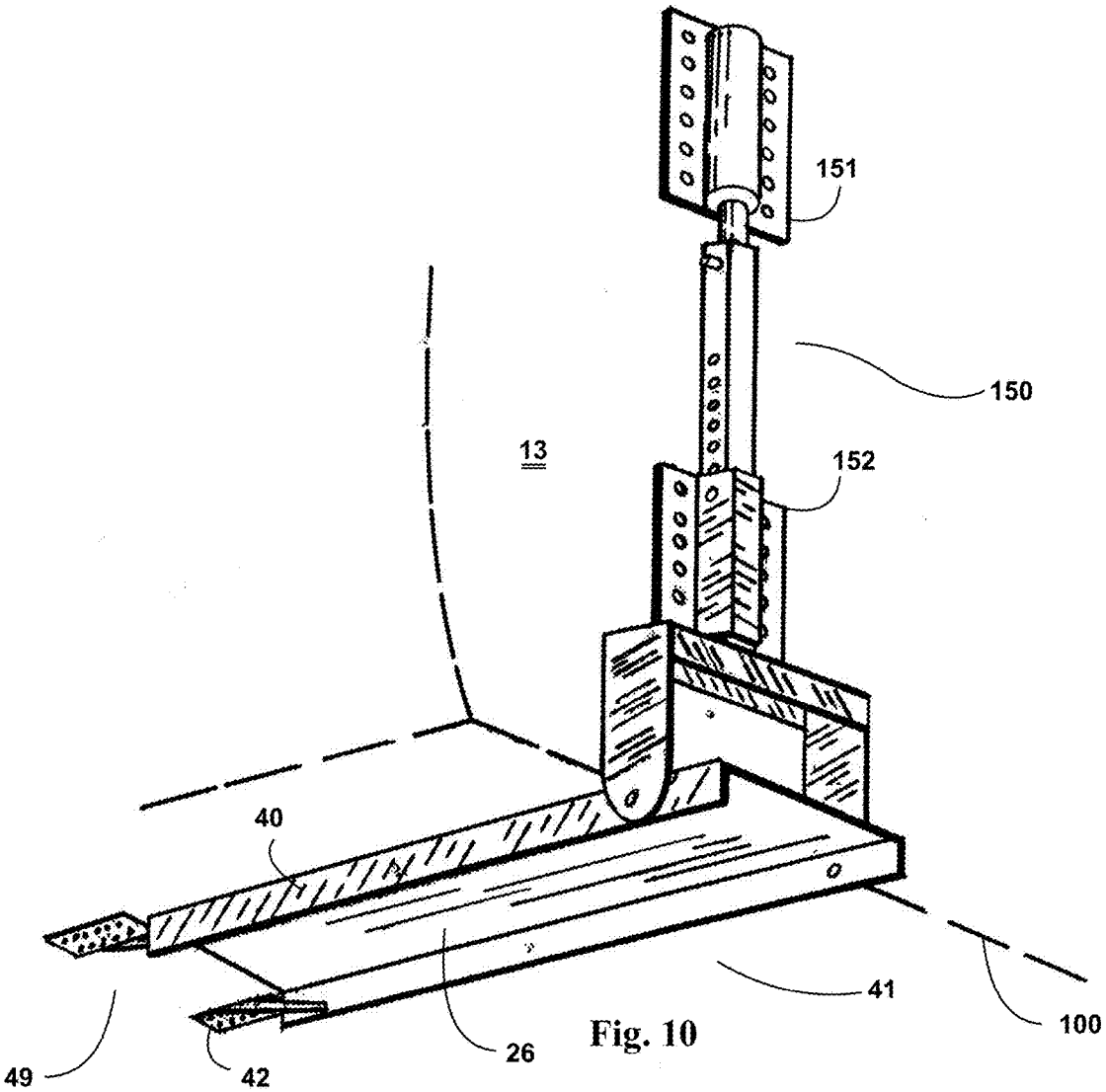
FIG. 10 is an isometric view from the rear of a watercraft, showing the trim tab raised flush to the horizon of the hull.

FIG. 5 shows the underside of the trim tab 41 using a version of a fluid hinge Type-42 and its components thereof. FIGS. 5A and 5B further show the fluid hinge Type-42 is comprised of a bracket 57 with a prong 55 that extends away from the hull 100. As shown in FIGS. 7, 8 and 10, a set of two brackets 57/57*a* connects to the hull 100 to support the trim tab 41. The prongs 55 rest against linear-support-tabs 40, but are not physically coupled together. Instead, the hinge provides support for the planar surface at rest to keep the trim tab from dipping below the horizon of the hull. When the watercraft is moving, the pressure of the water against the planar surface pushes the trim tab against the hull, thus negating the need for a fixed hinge. An actuator 150 connects the rear of the planar surface 26 to the transom 13 of the watercraft. This actuator is used to raise and lower the trim tab 41. The specific features of the actuator may vary, as any generic actuator would work. It is recommended that the actuator be mounted as close to a 90 degree angle as may be able.

Figure 6:
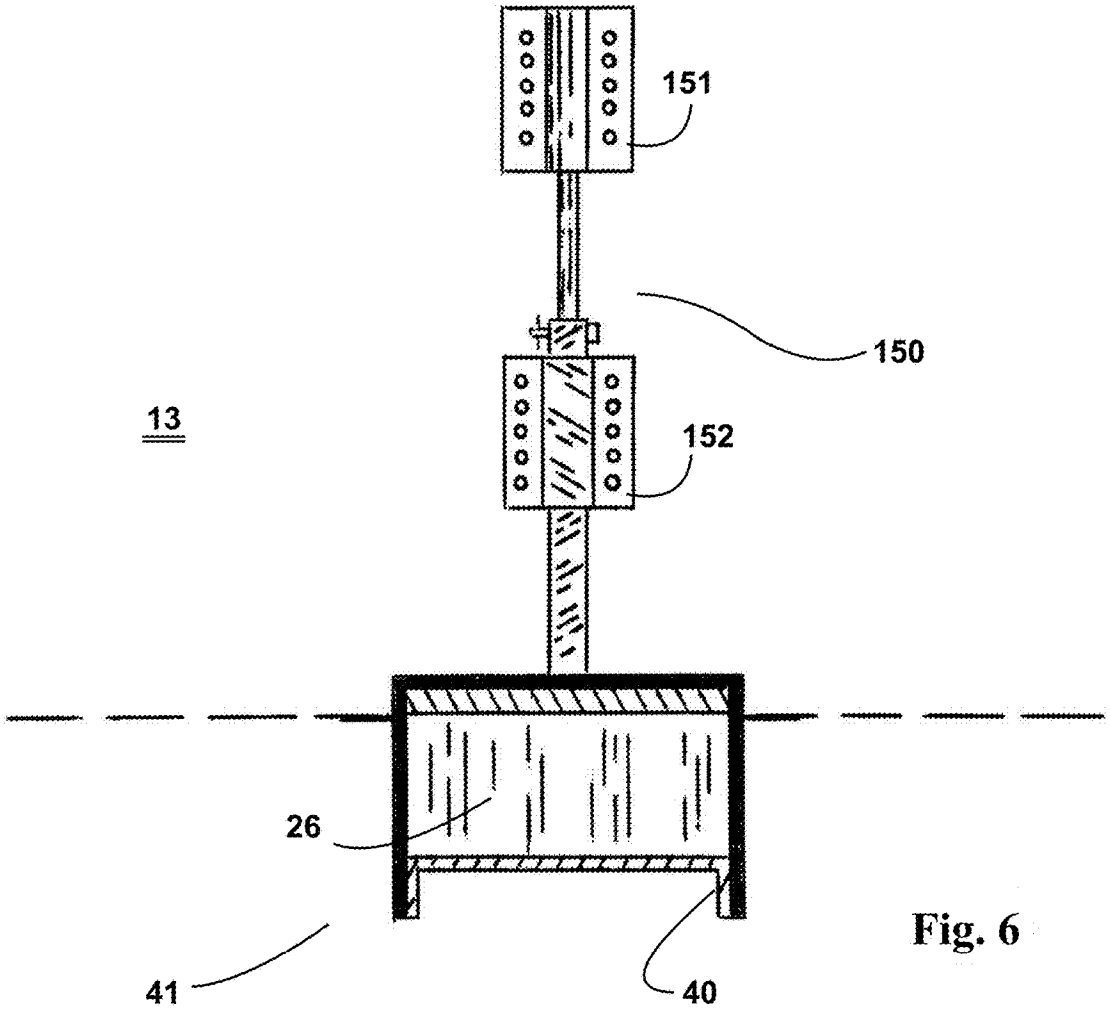
FIG. 6 is a view from the rear of a watercraft, showing the trim tab extended below the horizon of the hull.

FIG. 6 shows a view from the rear of the watercraft of the planar surface 26 of the trim tab 41 dipped at an angle below the horizon of the hull 100. It can bee seen that the rear of the planar surface 26 is extended downward from the hull 100 of the watercraft. A side view can be seen in FIG. 8, and an isometric view can be seen in FIG. 7. The combination of these three views demonstrate a method for increasing efficiency at higher speeds using a method of lowering the rear of the trim tab 41, with a size calculated based on the dimensions of the hull discussed above, and increasing the angle between the planar surface 26 and the hull 100.

Figure 20A:
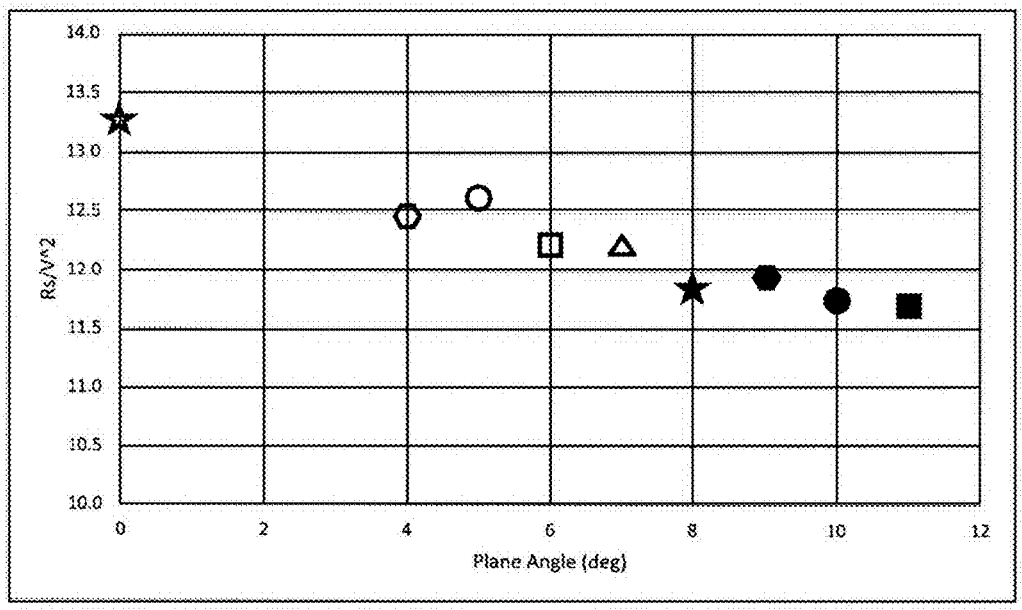
FIGS. 20A, 20B, and 20C show a visualization of the effect of trim plane angles on calm water performance at 25 knots for a tested model of a 92-foot Denison 121 Hull design in 1:24 scale.
Figure 20B:
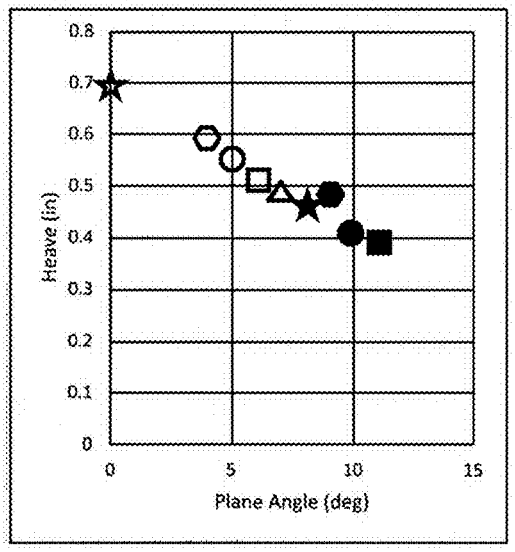
Figure 20C:
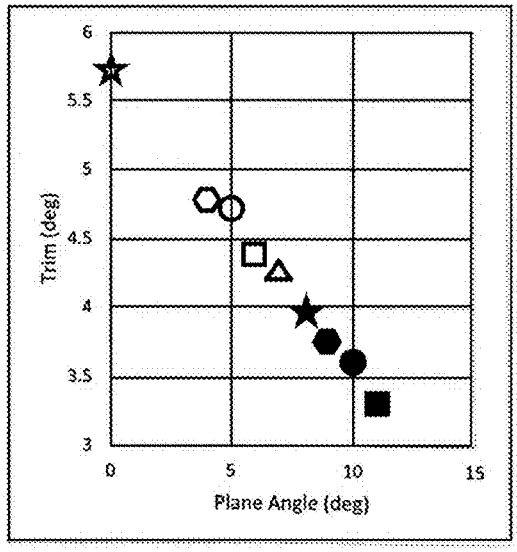
Figure 21A:
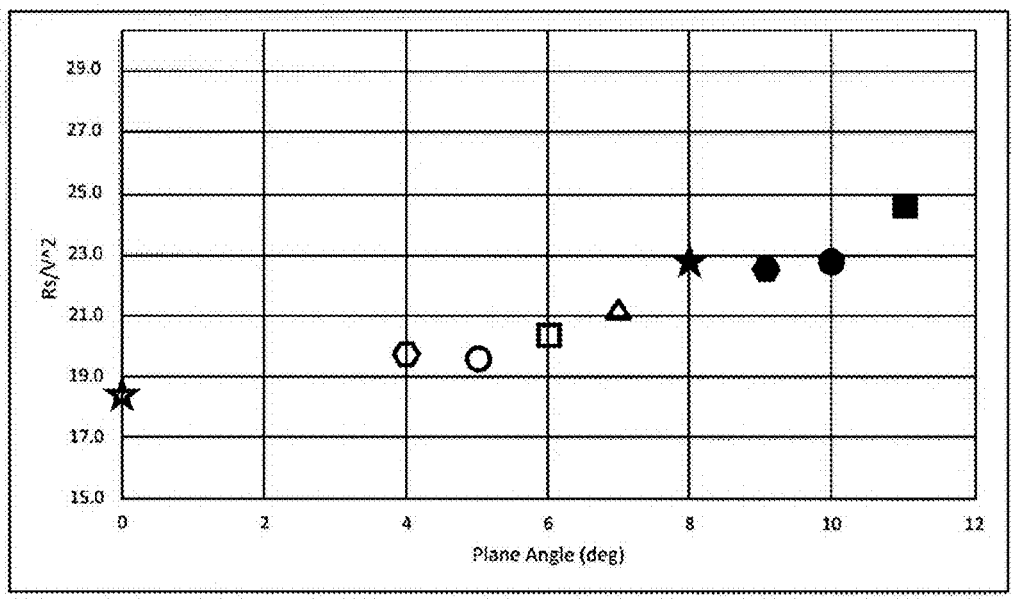
FIGS. 21A, 21B, and 21C show a visualization of the effect of trim plane angles on calm water performance at 10 knots for tested model of a 92-foot Denison 121 Hull design in 1:24 scale.
Figure 21B:
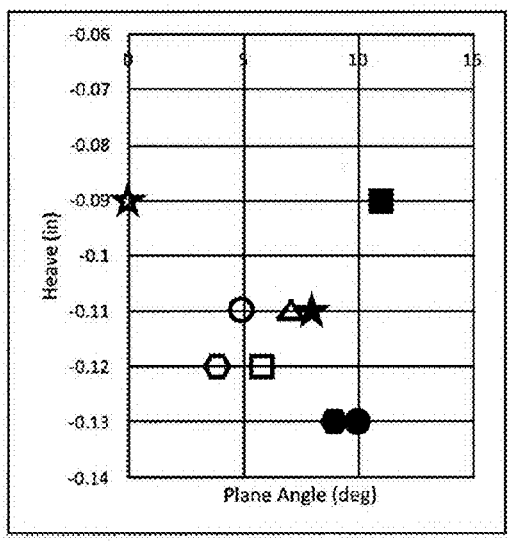
Figure 21C:
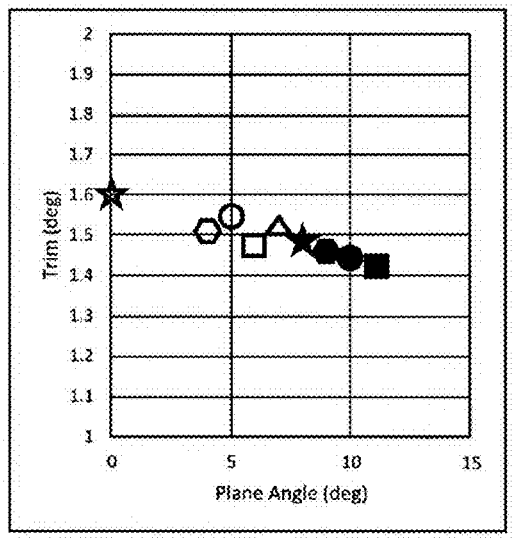
Figure 23A:
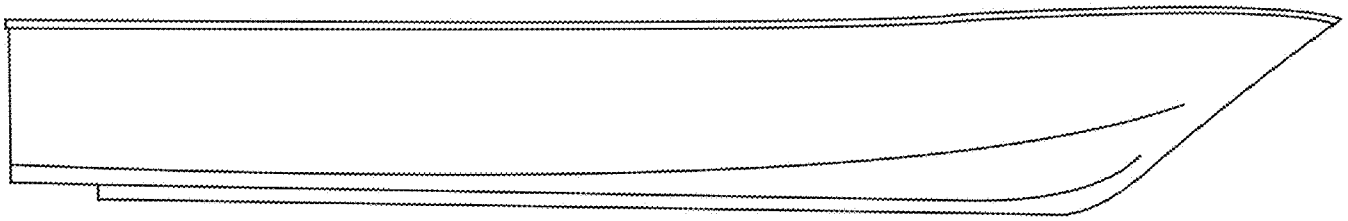
FIG. 23A is a side elevation of the 92' Denison 121 Hull.
Figure 23B:
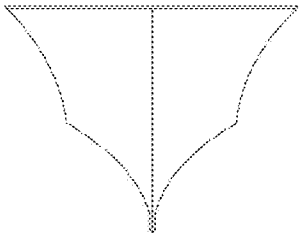
FIG. 23B is a bow-view elevation of the 92' Denison 121 Hull.
Figure 23C:
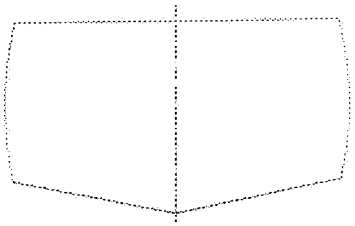
FIG. 23C is a transom elevation of the 92' Denison 121 Hull.
Figure 23D:
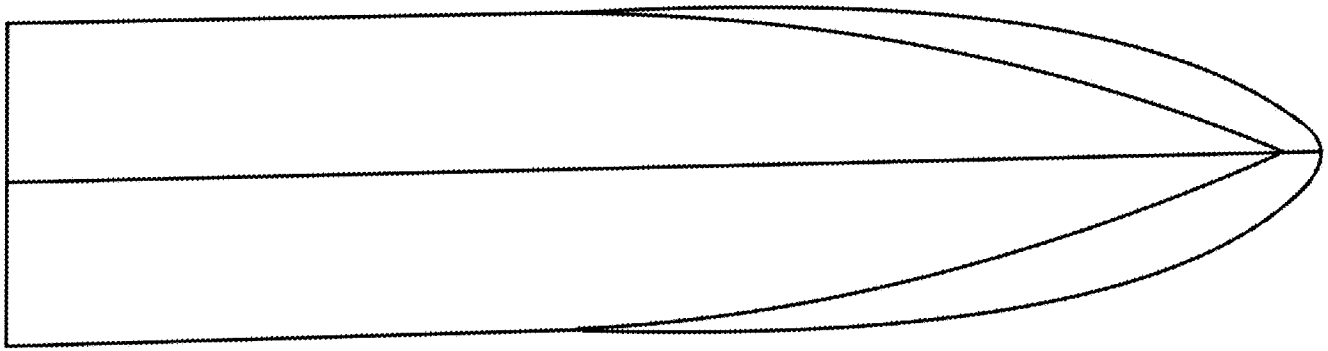
FIG. 23D is a bottom-view of the 92' Denison 121 Hull.

Shown in FIGS. 23A, 23B, 23C and 23D, are the side elevation view, elevation view of the bow, elevation view, and bottom-view of the transom of a 92-foot Denison Hull design 121. Shown in FIGS. 20A, 20B, 20C, and 22 are the results obtained in a trial of the above method, using a model of a 92-foot Denison Hull design 121 in 1:24 scale, tested at the Stevens Institute of Technology's Davidson Laboratory in Hoboken, N.J., and performs as follows. The method provides for increasing the watercraft to a higher speed. In this test, the watercraft was increased to about 25 knots. Further provided in the method is lowering the rear of the trim tab so that the angle between the hull of the watercraft and the planar surface of the trim tab is about 11 degrees. Observed from this test is a drag on the model of about 1.71 pounds. Scaled up to a full-sized 1:1 watercraft, this would be about 20,963 pounds. This 20,963 pounds of drag is about 2,763 pounds less than the results of a trim tab of the same scale with an angle of about 0 degrees. Next, observed is a trim of about 3.31 degrees. This about 3.31 degrees is about 2.41 degrees less than a trim tab at about 0 degrees. Further observed is a heave of the 1:24 scale model of about 0.39 inches. Scaled up to a full-sized 1:1 watercraft, this heave would be about 0.78 feet. This about 0.78 feet is about 0.6 feet less than the results of a trim tab of the same scale with an angle of about 0 degrees. Finally observed is an effective horsepower of about 1613 hp. This effective horsepower is about 211 hp less than the required effective horsepower than a trim tab at about 0. Noticed is the substantial difference in efficiency between the effective horsepower of a trim tab at 0 degrees and a trim tab at 11 degrees on a watercraft traveling at 25 knots. FIGS. 20A, 20B, 20C, 21A, 21B, and 21C also show a visualization of the results with charts that show the resistance forces, also known as drag, in relation to velocity, and charted against the plane angle, also referred to as the angle of the trim tab. The resistance forces are calculated using the resistance of a ship at 1:1 scale, dividing that value by the velocity in feet per second multiplied by itself, given by the equation: $R_S/V^2$. Also shown is the heave charted against the plane angle. It may be noted that a negative heave is referred to as sinkage. Further shown is the trim charted against the plane angle. FIGS. 20A, 20B, and 20C depict these charted relationships for a watercraft traveling at 25 knots, and FIGS. 21A, 21B, and 21C depict these charted relationships for a watercraft traveling at 10 knots.

The results of this test are highly accurate as the Davidson Laboratory is the facility used for military testing of watercrafts. These results have been obtained under controlled conditions with specific parameters. Different hulls and different conditions may lead to different variables. This is a specific trial, under specific conditions with a specific hull, and results may not match up exactly. However, these tests show overall features of the method.

FIG. 22 shows the Run number; velocity of the model, $V_M$, in feet per second; resistance forces on the model, $R_M$, in pounds; Trim in degree; heave of the model, $Heave_M$, in inches; heave of a ship scaled up to 1:1, $Heave_S$, in feet; velocity of a ship scaled up to 1:1, $V_S$, in knots; resistance forces on a ship scaled at 1:1, $R_S$, in pounds; and the effective horsepower, EHP. These results are shown at different speeds, and broken down into categories based on the angle of the trim tab.

In the conditions, for the tested trim tabs, the result of 11 degrees appeared to be the most efficient for the hull design. After 11 degrees, the efficiency may go down, but the overall efficiency would still be greater than a watercraft without a trim tab. It is likely that the trim tab degree will vary with hulls. The trim degree will need to be adjusted on a hull-by-hull basis. After a degree of 20 degrees, it is likely that this may begin to having a breaking effect on the hull. The use of 30 knots in the testing conditions was used to prove the method workable, however, as speed increases, tab angle may need to be adjusted to provide for maximum efficiency. The tested material used in the scaled model is 1 mm thick aluminum. The most common material used in trim tab design is stainless steel, but materials can vary between stainless steel, aluminum, bronze, brass, carbon fiber, fiberglass, or other material known to be used in trim tab design.

Figure 9:
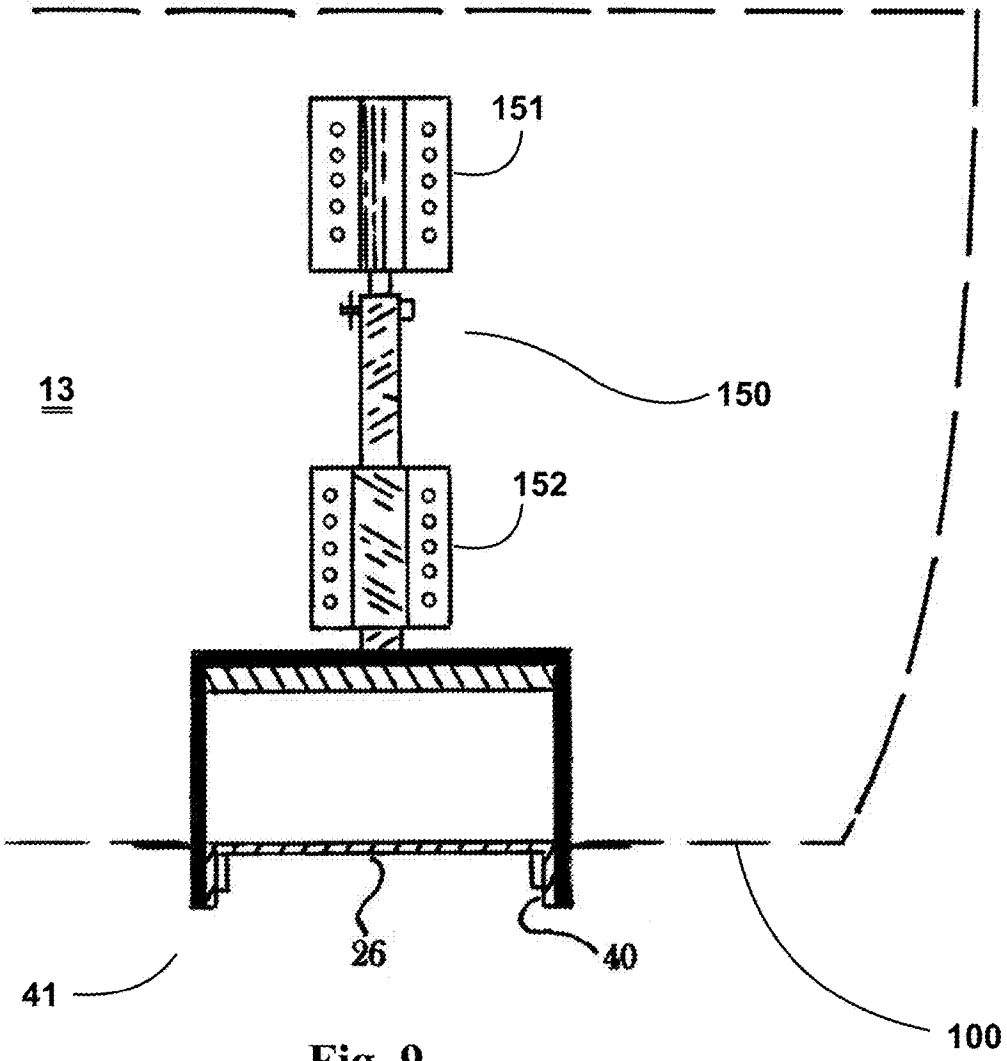
FIG. 9 is a view from the rear of a watercraft, showing the trim tab raised flush to the horizon of the hull.

FIG. 9 shows a view from the rear of the watercraft of the planar surface 26 of the trim tab 41 raised to an angular position sitting about flush to horizon of the hull 100. It can bee seen that the rear of the planar surface 26 is about flush to the hull 100 of the watercraft. A side view can be seen in FIGS. 12, 13, and 13A, and an isometric view can be seen in FIG. 10. The combination of these three views demonstrate a method for increasing efficiency at lower speeds by raising the rear of the trim tab 41 and decreasing the angle between the planar surface 26 and the hull 100.

Shown in FIGS. 21A, 21B, 21C, and 22 are the results obtained in a trial of the above method, using a model of a 92-foot Hull design 121 in 1:24 scale, tested at the Stevens Institute of Technology's Davidson Laboratory and performs as follows. The method provides for decreasing the watercraft to a lower speed. In this test, the watercraft was decreased to about 10 knots. Further provided in the method is raising the rear of the trim tab so that the angle between the hull of the watercraft and the planar surface of the trim tab is about 0 degrees. Observed from this test is a drag on the model of about 0.42 pounds. Scaled up to a full-sized 1:1 watercraft, this would be 5,234 pounds. This 5,234 pounds of drag is about 1416 pounds less than the results of a trim tab of the same scale with an angle of about 11 degrees. Next, observed is a trim of about 1.6 degrees. This about 1.6 degrees is about 0.13 degrees more than a trim tab at about 11 degrees. Further observed is a sinkage of the 1:24 scale model of about 0.09 inches. Scaled up to a full-sized 1:1 watercraft, this sinkage would be about 0.18 feet. This about 0.18 feet is about 0.10 feet more than the results of a trim tab of the same scale with a trim tab angle of about 11 degrees. Finally observed is an effective horsepower of about 161 hp. This effective horsepower is about 44 hp less than the required effective horsepower than a trim tab at about 11 degrees. Noticed is the substantial difference in efficiency between the effective horsepower of a trim tab at 11 degrees and a trim tab at 0 degrees on a watercraft traveling at 10 knots.

Figures 11, 11A:
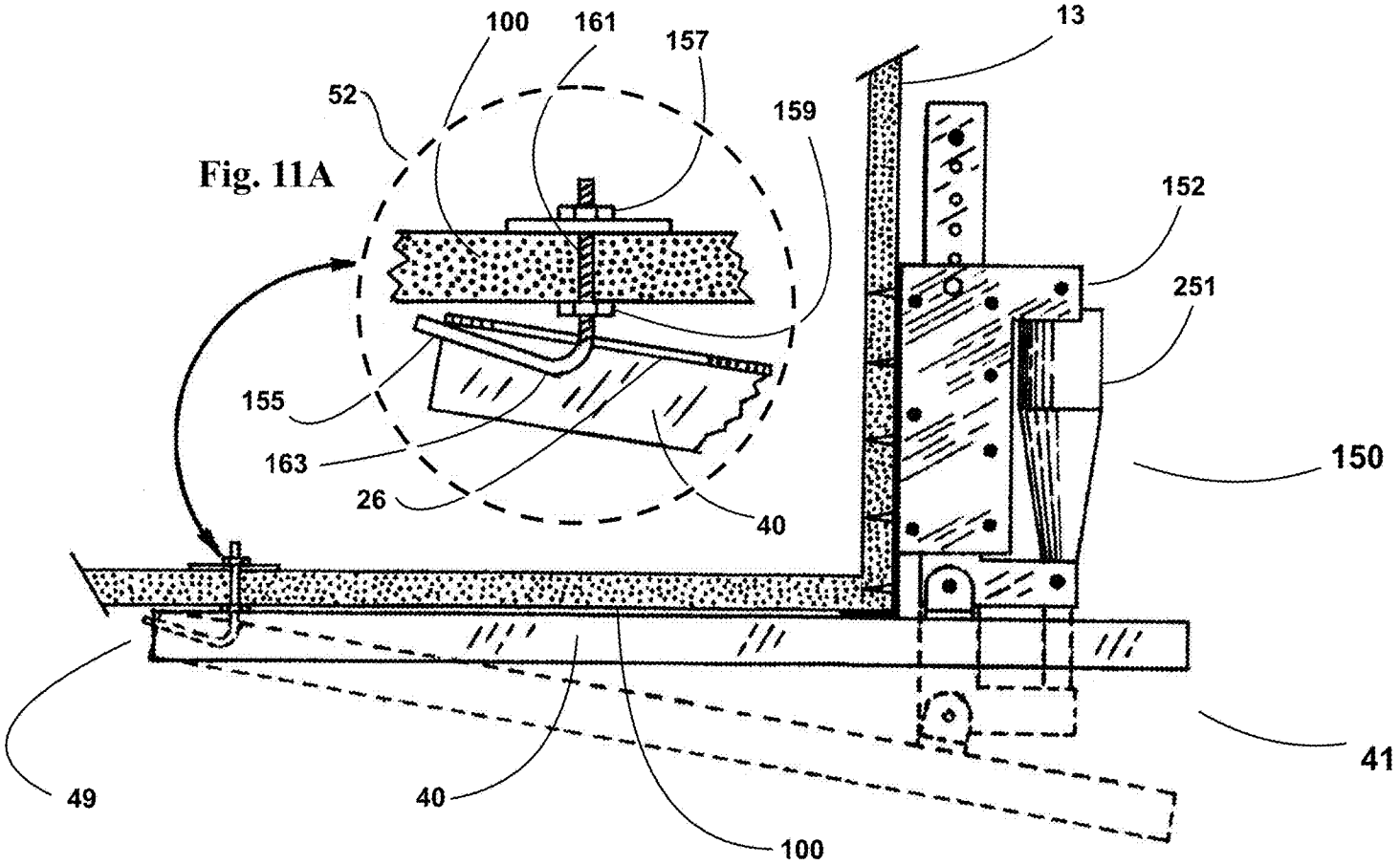
FIGS. 11 and 11A show a side view from the port side of the rear hull of a watercraft looking starboard, showing the trim tab raised flush to the horizon of the hull, the relationship between raised and lowered, and using a Type-52 fluid hinge.

Further shown in FIGS. 10, 11, 11A, 12, 16, and 17, are different versions of acceptable fluid hinges. FIG. 10 shows the fluid hinge, Type-42, as described above. FIGS. 11 and 11A show a method of using a fluid hinge Type-52, involving a bent pin 155 with threaded portion 161 connecting the pin 155 to the hull 100, and fastened to the hull 100 of the watercraft by use of a threaded top nut 157 and bottom nut 159. The pin 155 faces the front of the hull 100 and is bent 163 toward the hull 100. This orientation keeps the planar surface 26 of the trim tab 41 from dipping below the horizon of the hull 100 of the watercraft a low speeds and rest, similar to the hinge of Type-42. The hinge is not physically coupled to the planar surface 26, or any part of the trim tab 41.

Figure 12:
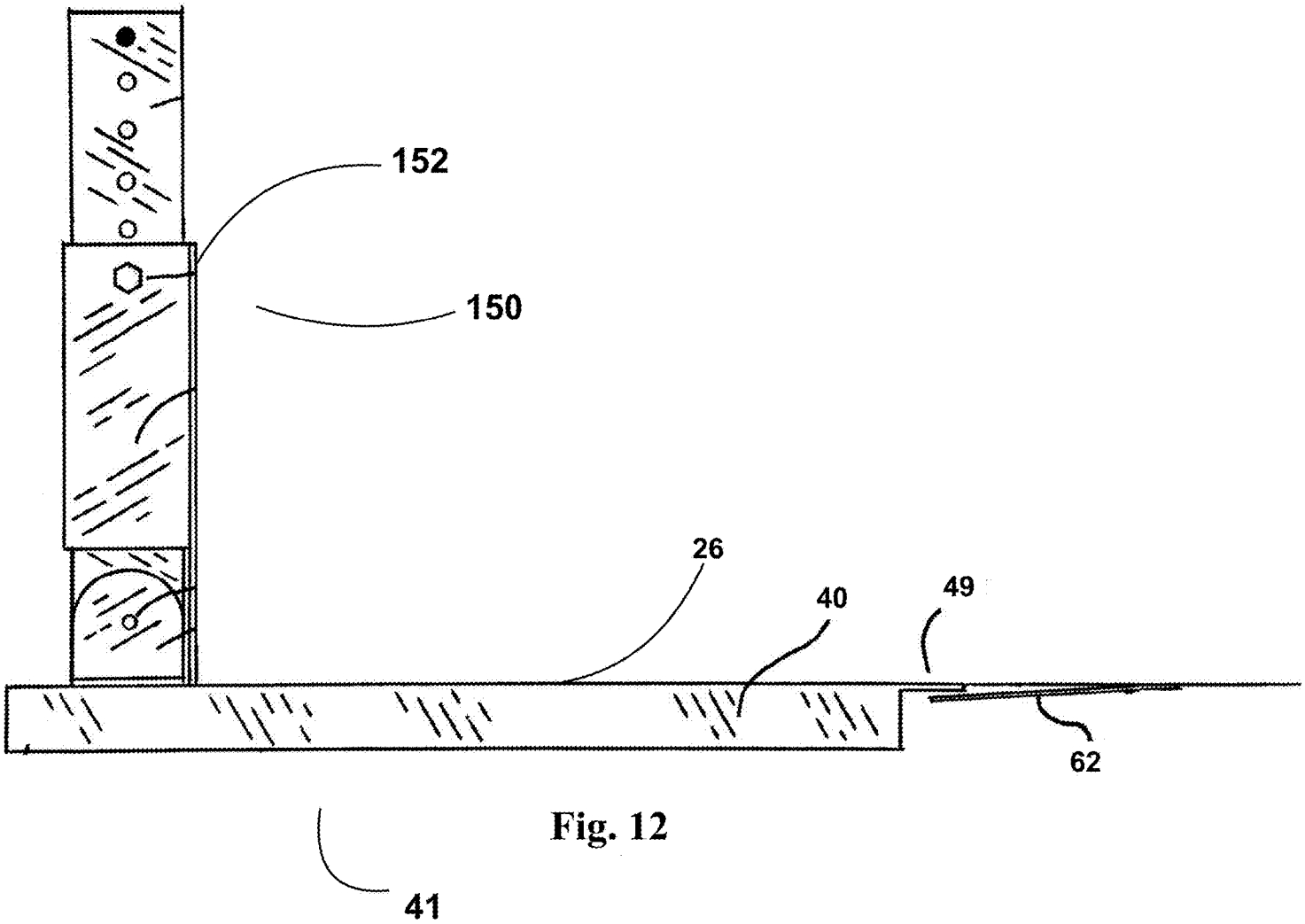
FIG. 12 is a side view from the starboard side of the rear hull of a watercraft looking port, showing the trim tab raised flush to the horizon of the hull, and using a Type-62 fluid hinge.
Figure 13:
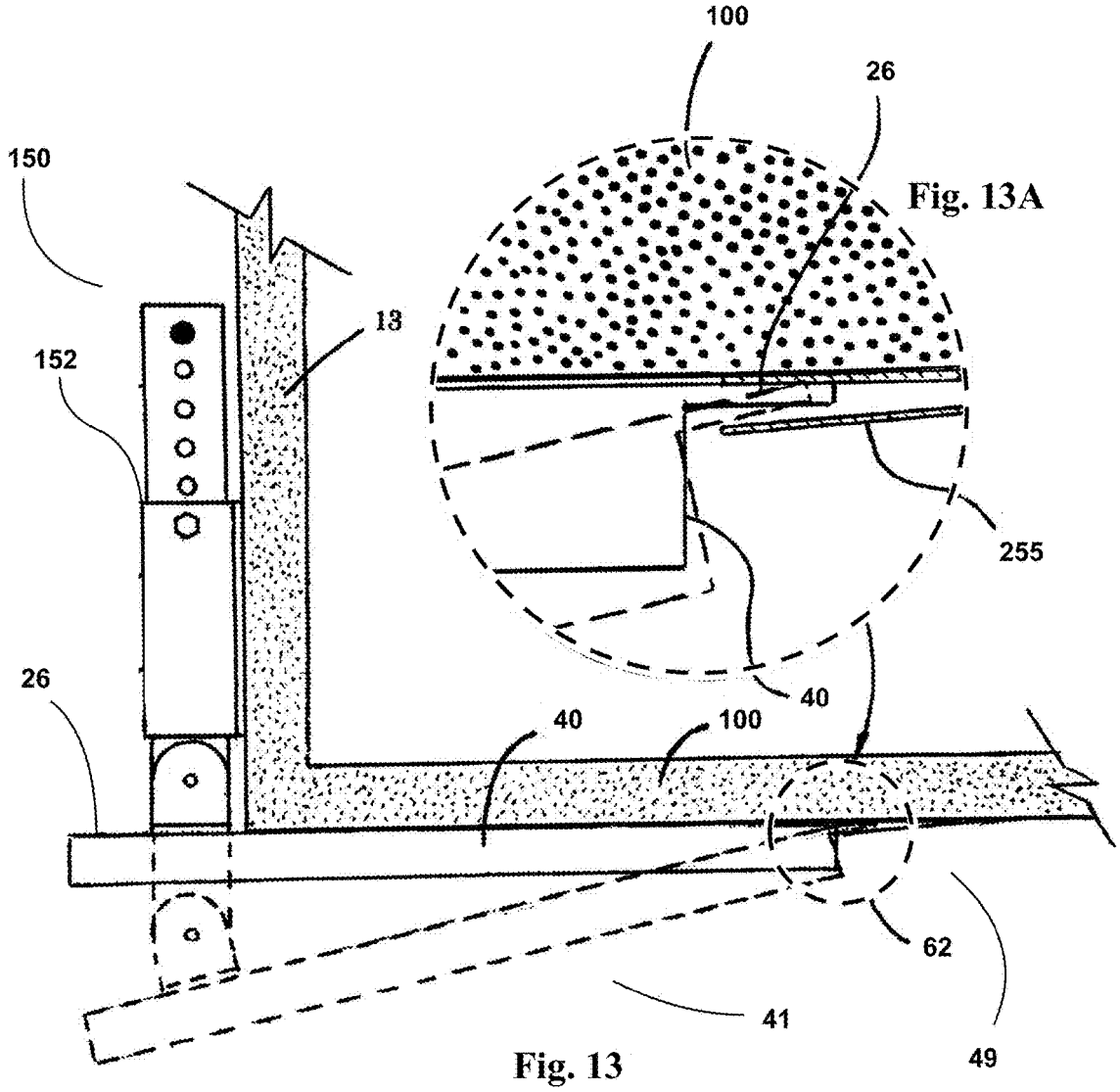
Figure 14:
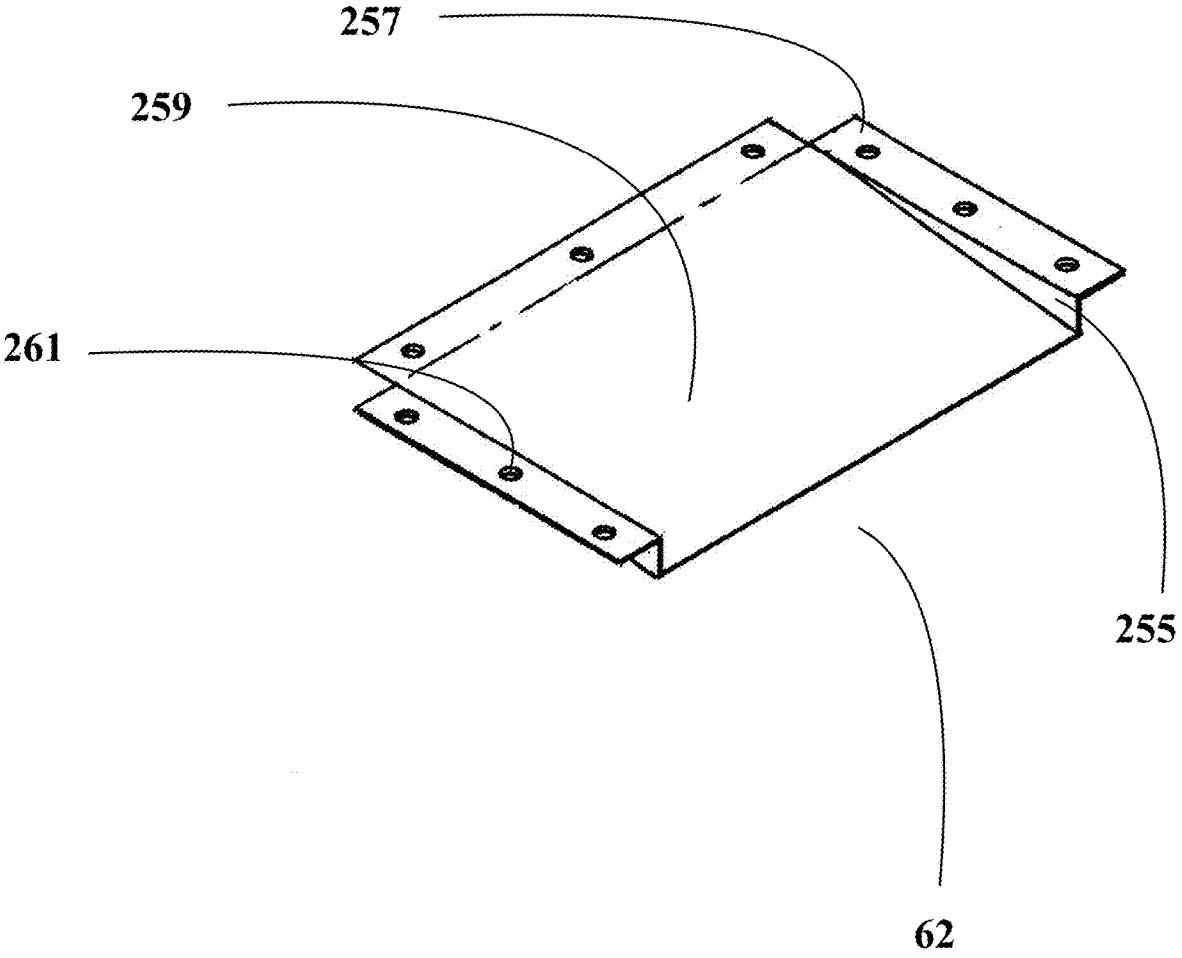
FIG. 14 is a view of the Type-62 fluid hinge, showing the elements of the Type-62 fluid hinge.
Figure 15:
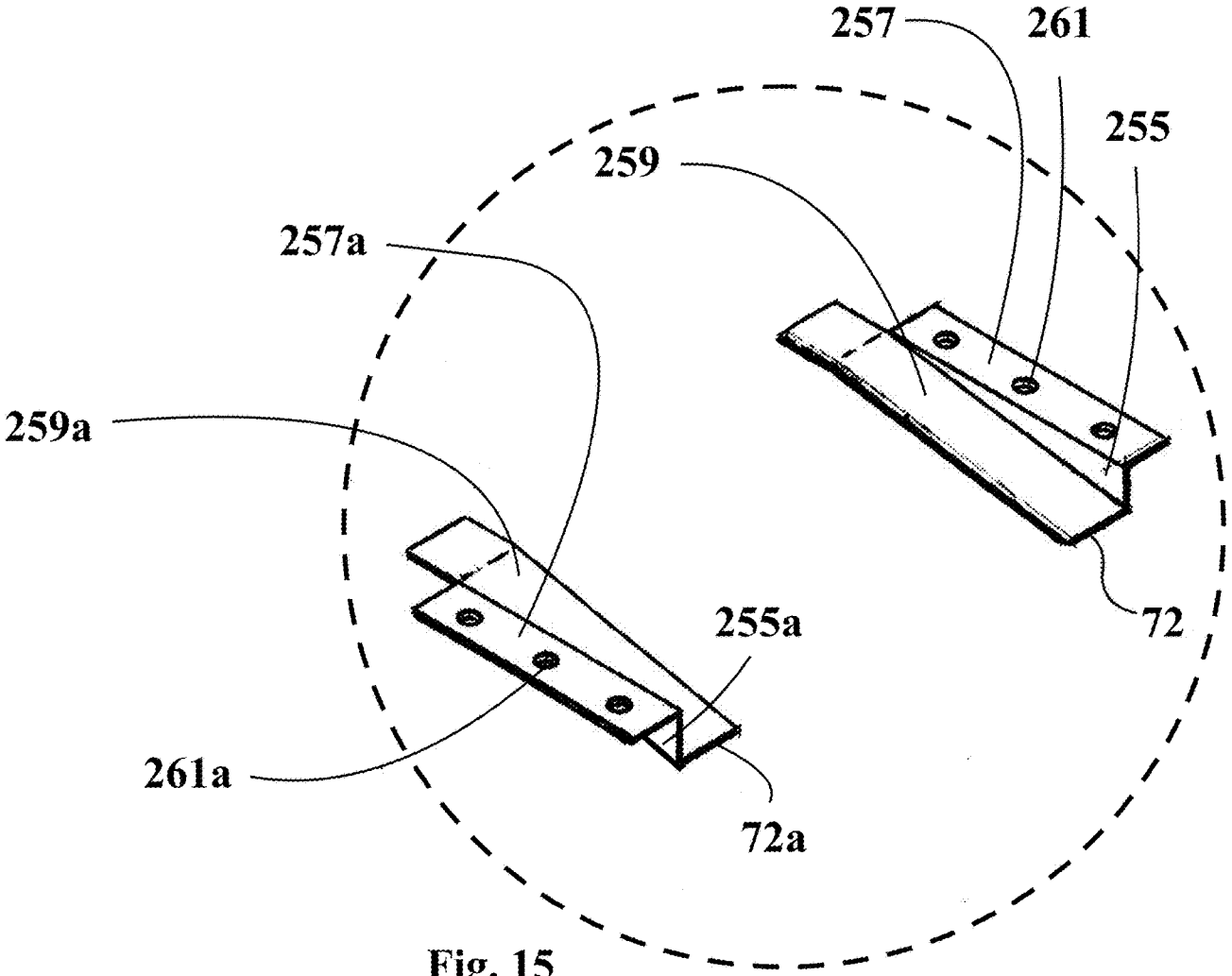
FIG. 15 is a view of the Type-72 fluid hinge, showing the elements of the Type-72 fluid hinge.

FIGS. 12, 13, and 13A show a method of using a fluid hinge Type-62 that involves a pocket 255 enclosing a portion of the planar surface 26. This portion of the planar surface 26 extends past the linear-support-tabs 40 to provide a complemental insertion to the pocket 255 of the fluid hinge 49 Type-62. This Type-62 pocket keeps the planar surface 26 of the trim tab 41 from dipping below the horizon of the hull 100 of the watercraft a low speeds and rest, similar to the hinge of Type-42. The hinge is not physically coupled to the planar surface 26, or any part of the trim tab 41. FIGS. 14 and 15 further show how this pocket bracket. FIG. 14 shows the pocket bracket of Type-62 as a continuous piece, while FIG. 15 shows a similar embodiment 72 and 72*a* as smaller pieces that perform the same function, but are mounted separately. Both contain a supporting wall 259, side wall 255 to keep the planar surface 26 from moving laterally, a bracket 257 where openings 261 can be used for securement to the hull 100.

Figure 16:
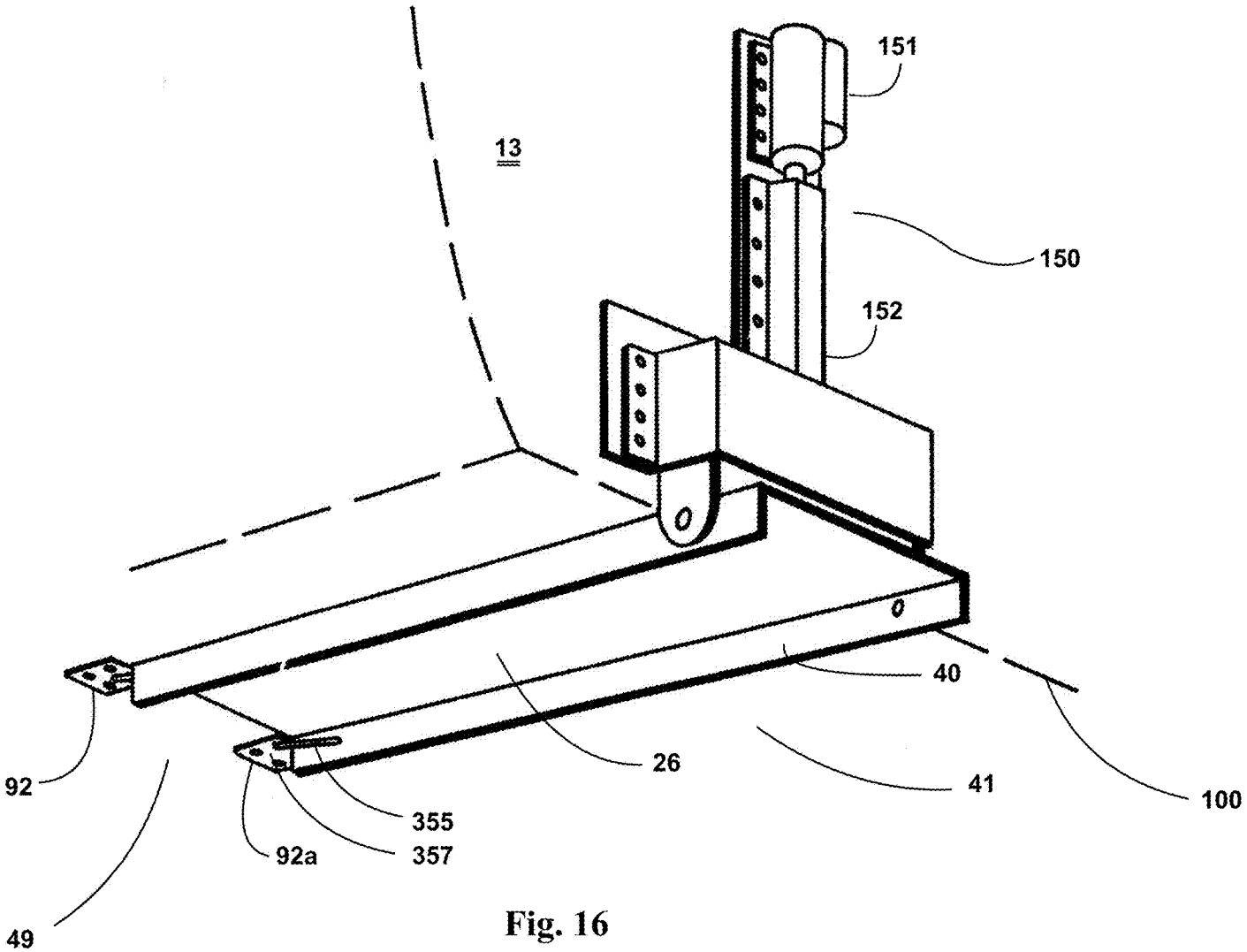
FIG. 16 is an isometric view from the rear of a watercraft, showing the trim tab raised flush to the horizon of the hull using a Type-92 fluid hinge.

FIG. 16 shows a fluid hinge Type-92 and 92a similar to fluid hinge Type-42. The main difference between the two versions is element 55 in the fluid hinge Type-42 and element 355 in fluid hinge Type-92. Element 355 is a rod that protrudes from a bracket 357. While the look is slightly different, the functionality remains the same. The rod 355 keeps the planar surface 26 of the trim tab 41 from dipping below the horizon of the hull 100 of the watercraft a low speeds and rest, similar to the hinge of Type-42. The hinge is not physically coupled to the planar surface 26, or any part of the trim tab 41.

Figure 17:
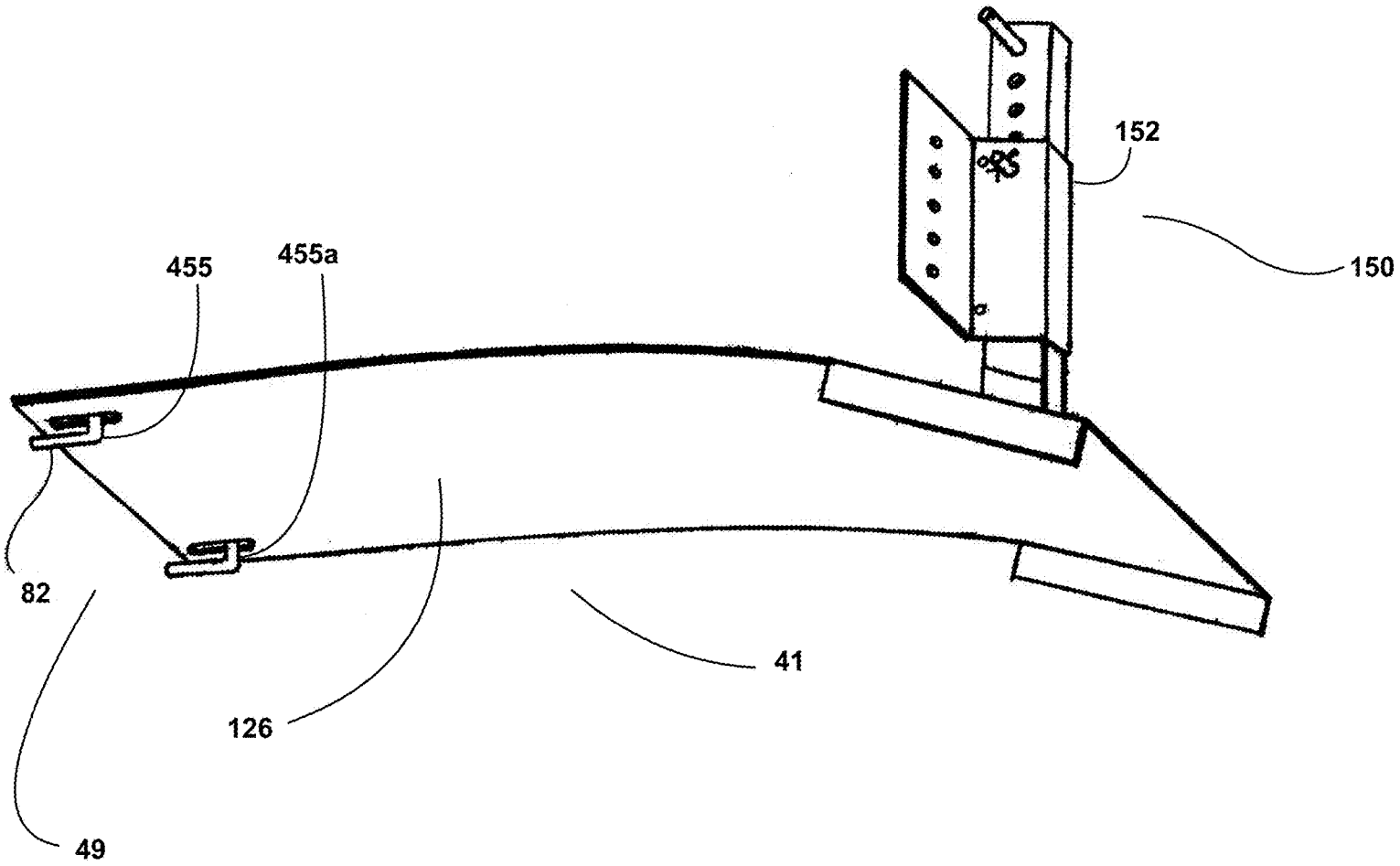
FIG. 17 is an isometric view from the rear of a watercraft, showing a trim tab with a flexible surface using a Type-82 fluid hinge.

FIG. 17 shows fluid hinge Type-82. The hinge has two bent rods 455 and 455*a* connected to the hull 100 FIG. 17 further shows a second embodiment of a trim tab 41 with a flexible planar surface 126 made of a flexible material. The fluid hinge Type-82 is used to secure the flexible surface 126, but may also be used to secure the planar surface 26. The pins work as a hinge, allowing the surface to be secured to the hull, but not physically coupled. This allows the surface 126 or 26 to move freely when an actuator 150 pushes down on the rear of the tab. The fluid hinge Type-82 also keeps the front of the surface 126 or 26 of the trim tab 41 from dipping below the horizon of the hull 100 of the watercraft when the watercraft is at low speeds or rest.

Figure 18:
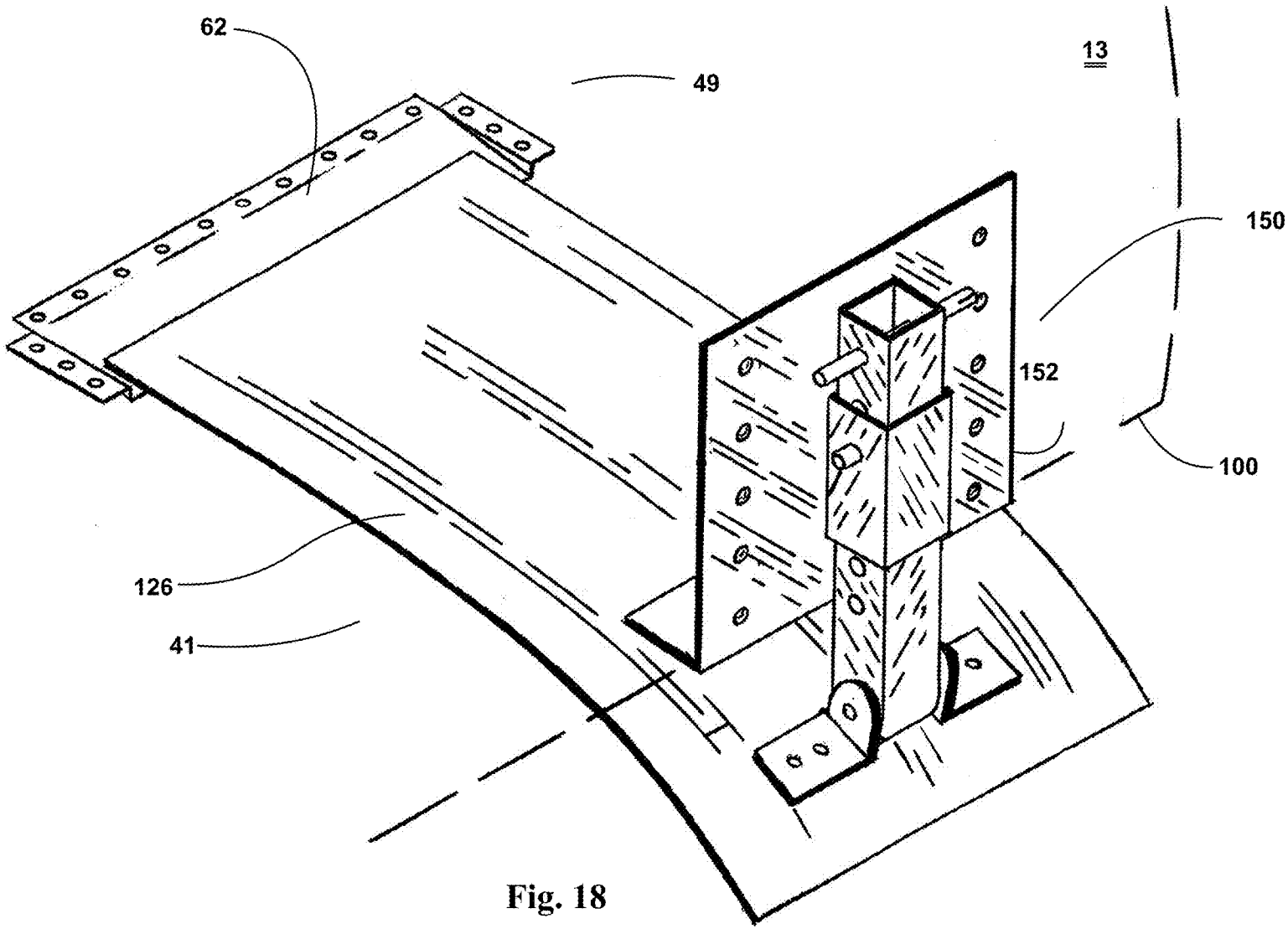
FIG. 18 is an isometric view from the rear of a watercraft, showing a trim tab with a flexible surface using a Type-62 fluid hinge.

In FIG. 18 is shown a flexible planar surface 126 using the fluid hinge Type-62. The pocket of the hinge formed from the bracket of fluid hinge Type-62 and the hull 100 of the watercraft provides support for the flexible planar surface 126 at low speeds and rest. This support keeps the flexible planar surface 126 from dipping below the horizon of the hull 100. At higher speeds, the planar surface 126 is pushed up against the hull 100 of the watercraft, and there is no need for a hinge. The bracket of fluid hinge Type-62 allows the planar surface 126 to be physically disconnected from any hinging mechanism, which allows the tab 41 to move freely and accomplish its goal.

Figure 19:
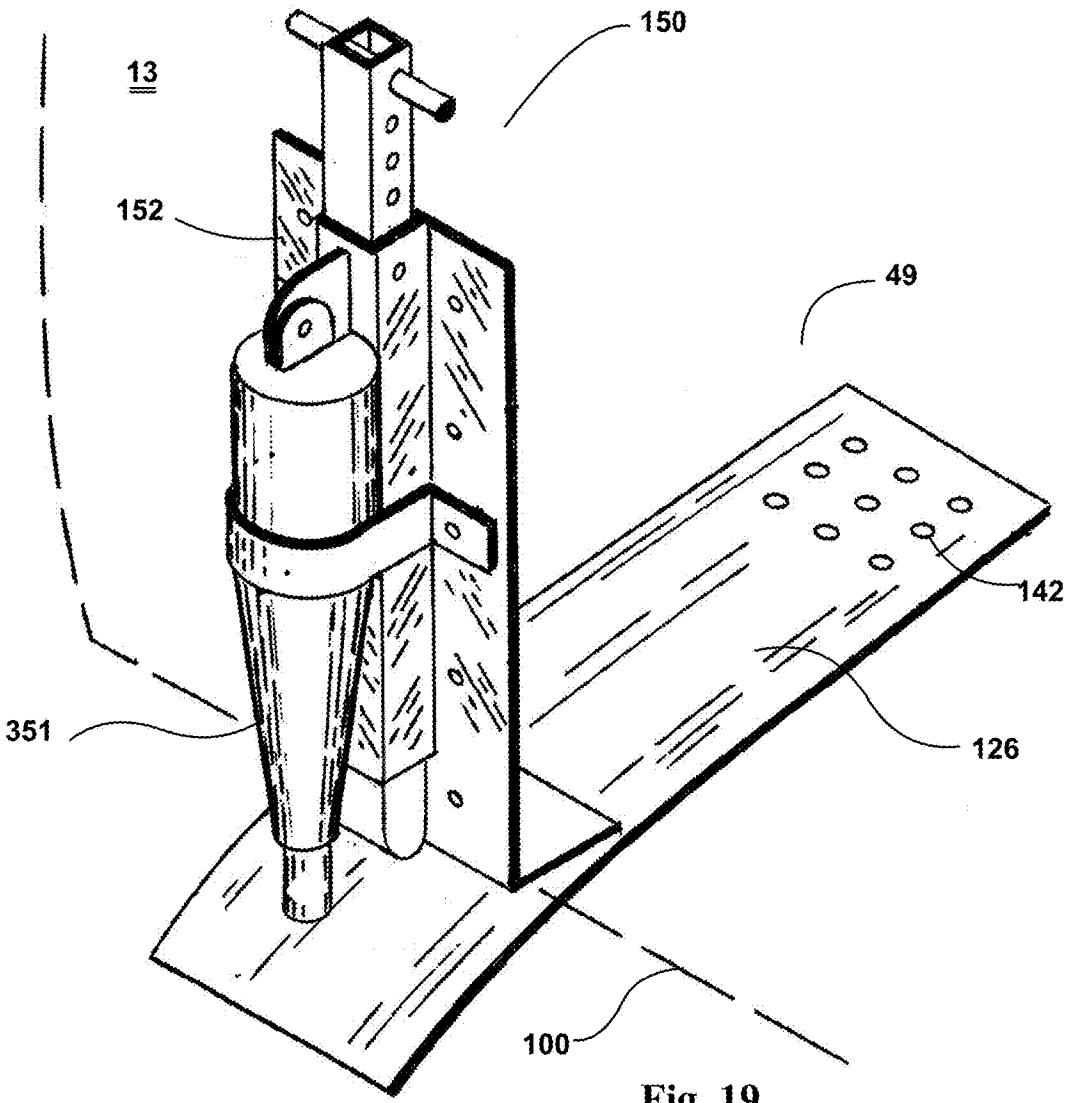
FIG. 19 is an isometric view from the rear of a watercraft, showing a trim tab with a flexible surface using a Type-142 fixed hinge with fluidly-connected actuator.

FIG. 19 shows a flexible tab with a fixed hinge, and a non-fixed actuator 351. Unlike the other fluid hinges 49 in the previous figures. Fluid hinge 49, i.e., Type-142, allows the tab to move freely as in the other embodiments, but rather than being fixed by an actuator 150, the fixed connection of flexible planar surface 126 in FIG. 19 is to the hull 100 of the watercraft, and the actuator 351 lacks a physical connection to allow the tab to move freely as needed.

While there has been shown and described above the preferred embodiment of the instant method it is to be appreciated that the method may be embodied otherwise than is herein specifically shown and described and that, within said method, certain changes may be made in the form and arrangement of the parts without departing from the underlying ideas or principles of this method as set forth in the Claims appended herewith.

I claim:

1. A method for watercraft efficiency at various speeds by use of at least one trim tab and calculating total surface area of each planar surface of the trim tab, the method comprising:

determining the surface area necessary of the planar surface of at least one trim tab;

mounting said trim tab substantially under a hull;

determining an overall length of the hull;

determining a maximum beam of the hull;

multiplying the overall length of the hull by the maximum beam of the hull;

taking a resultant of the overall length and maximum beam and multiplying that resultant by a percentage in the range of one to three percent;

taking said resultant and dividing it by the number of trim tabs mounted to the hull;

using two planar surfaces;

mounting one trim tab on a port side;

mounting one trim tab on a starboard side;

mounting a planar surface of said trim tab using a fluid-hinge to connect a front-most portion of the planar surface to the hull; and using at least one actuator to connect a rear-most portion of the planar surface to a transom of the watercraft.

2. The method as recited in claim 1, further comprising:

(a) securing the planar surface through use of a fluid-hinge by providing at lease one member secured to the hull on which the planar surface of the trim tab may rest;

(b) using said members secured to the hull to contain the planar surface in a position so that the planar surface rests about flush to the hull of the watercraft;

(c) providing said planar surface not physically being connected to any member, other than an actuator; and (d) providing said members not taking any load from the planar surface except at rest to keep the planar surface from dipping below a horizon of the hull.

3. The method as recited in claim 1, further comprising:

increasing efficiency at higher speeds by lowering a rear portion of the at least one trim tab and increasing an angle between the planar surface and the hull.

4. The method as recited in claim 1, further comprising:

increasing efficiency at lower speeds by raising a rear portion of the trim tab and decreasing an angle between the planar surface and the hull toward zero degrees from a horizon of the hull.

5. The method as recited in claim 3, further comprising:

(a) increasing efficiency at a higher speed on a 1:24 scale model of a 92-foot Denison 121 hull design by adjusting the watercraft's speed to 25 kts;

(b) lowering the rear of the trim tab so that the angle between the hull of the watercraft and the planar surface of the trim tab is 11 degrees;

(c) observing a drag of 1.7 lbs, and 0.2 lbs less than a trim tab at about 0 degrees;

(d) observing an trim of 3.3 degrees, and 2.4 degrees less than a trim tab at 0 degrees;

(e) observing a heave of 0.4 inches, and 0.3 inches less than a trim tab at 0 degrees; and (f) observing required horsepower of 1613, and 210 hp less than the required horsepower than a trim tab at 0.

6. The method as recited in claim 4, further comprising:

(a) increasing efficiency at a lower speed of a 1:24 scale model of a 92-foot Denison 121 hull design by adjusting the watercraft's speed to 10 kts;

(b) raising the rear of the trim tab so that the angle between the hull of the watercraft and the planar surface of the trim tab is 0 degrees;

(c) observing a drag of 0.4 lbs, and 0.1 lbs less than a trim tab at 11 degrees;

(d) observing an trim of 1.6 degrees, 0.1 degrees less than a trim tab at 11 degrees;

(e) observing a heave of −0.09 inches, and −0.04 inches more than a trim tab at 11 degrees; and (f) observing required horsepower of 160, and 44 hp less than the required horsepower than a trim tab at 7 degrees.

7. The method as recited in claim 1, further comprising:

using two flexible surfaces;

mounting one trim tab on the port side; and mounting one trim tab on the starboard side.

8. A method for watercraft efficiency at various speeds by use of at least one trim tab and calculating total surface area of each planar surface of the trim tab, the method comprising:

determining the surface area necessary of the planar surface of at least one trim tab;

mounting said trim tab substantially under a hull;

determining an overall length of the hull;

determining a maximum beam of the hull;

multiplying the overall length of the hull by the maximum beam of the hull;

taking a resultant of the overall length and maximum beam and multiplying that resultant by a percentage in the range of one to three percent;

taking said resultant and dividing it by the number of trim tabs mounted to the hull;

mounting a planar surface of said trim tab using a fluid-hinge to connect a front-most portion of the planar surface to the hull; and using at least one actuator to connect a rear-most portion of the planar surface to a transom of the watercraft.

9. A method for watercraft efficiency at various speeds, the method comprising:

having a use of at least one flexible trim tab;

determining the surface area necessary of a flexible surface of at least one trim tab;

mounting said trim tab substantially under the hull;

calculating total surface area of each flexible surface;

determining the overall length of the hull;

determining the maximum beam of the hull;

multiplying the overall length of the hull by the maximum beam of the hull;

taking a resultant of the overall length and maximum beam and multiplying that resultant by a percentage in the range of one to three percent;

taking said resultant and dividing it by the number of trim tabs mounted to the hull;

mounting the planar surface by using a fluid hinge to connect the front-most portion of the planar surface to the hull; and using an actuator to connect the rear-most portion of the flexible surface to the transom of the watercraft.

* * * * *